US011320192B2

(12) United States Patent
Lee et al.

(10) Patent No.: US 11,320,192 B2
(45) Date of Patent: May 3, 2022

(54) REFRIGERATOR

(71) Applicant: Samsung Electronics Co., Ltd., Suwon-si (KR)

(72) Inventors: Chomin Lee, Suwon-si (KR); Byoungmok Kim, Suwon-si (KR); Oungu Lee, Suwon-si (KR); Jeonghyun Lee, Suwon-si (KR); Dongyeong Kim, Suwon-si (KR); Minseok Choi, Suwon-si (KR); Yang-yeol Gu, Suwon-si (KR); Ae-ryun Kim, Suwon-si (KR); Yountae Shin, Suwon-si (KR); Donghyun Lee, Suwon-si (KR); Seonju Lee, Suwon-si (KR); Jaemin Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 29 days.

(21) Appl. No.: 16/849,209

(22) Filed: Apr. 15, 2020

(65) Prior Publication Data

US 2020/0326119 A1 Oct. 15, 2020

(30) Foreign Application Priority Data

Apr. 15, 2019 (KR) ..... 10-2019-0043937
Jul. 17, 2019 (KR) ..... 10-2019-0086074

(51) Int. Cl.
*F25D 23/02* (2006.01)

(52) U.S. Cl.
CPC ..... *F25D 23/02* (2013.01); *F25D 2323/021* (2013.01)

(58) Field of Classification Search
CPC .... F25D 23/02; F25D 2400/18; F25D 23/028; F25D 2323/021; A47B 2096/208
(Continued)

(56) References Cited

U.S. PATENT DOCUMENTS 4,583,796 A 4/1986 Nakajima et al.
4,765,697 A 8/1988 Gardell
(Continued)

FOREIGN PATENT DOCUMENTS

CA 2 536 420 A1 8/2007
CN 1075001 A 8/1993
(Continued)

OTHER PUBLICATIONS

Extended European Search Report dated Jul. 1, 2021, in corresponding European Patent Application No. 20800542.1.
(Continued)

*Primary Examiner* — Hiwot E Tefera
(74) *Attorney, Agent, or Firm* — Staas & Halsey LLP

(57) ABSTRACT

A refrigerator including: a main body forming a storage compartment and a door provided to open and close the storage compartment, wherein the door includes a door frame, a cover arranged in front of the door frame and including a cover fixer, and a door panel arranged in front of the cover, the door panel including a first fixer and a second fixer on a rear surface of the door panel. When the door panel is coupled to a front side of the cover, the first fixer is coupled to the door frame and the second fixer is coupled to the cover.

13 Claims, 24 Drawing Sheets

(58) Field of Classification Search
USPC ..... 312/265.6, 204, 265.5
See application file for complete search history.

(56) References Cited

U.S. PATENT DOCUMENTS

| | | | | |
|---|---|---|---|---|
| 5,358,326 | A | 10/1994 | Cherry | |
| 6,722,083 | B2 | 4/2004 | Herrmann | |
| 6,840,773 | B2 | 1/2005 | Anderson | |
| 7,516,531 | B2 | 4/2009 | Crompton | |
| 7,673,472 | B2 | 3/2010 | Kwon | |
| 8,104,853 | B2 | 1/2012 | Kim | |
| 8,336,974 | B2 | 12/2012 | Lee | |
| 8,336,975 | B2 | 12/2012 | Allard | |
| 8,353,564 | B2 | 1/2013 | Kim | |
| 8,366,221 | B2 | 2/2013 | Kim | |
| 8,408,665 | B2 | 4/2013 | Lim | |
| 8,567,885 | B2 | 10/2013 | Lee | |
| 8,668,292 | B2 | 3/2014 | Pae | |
| 8,789,900 | B2 | 7/2014 | Laible | |
| 9,185,981 | B1 | 11/2015 | Kane | |
| 9,279,609 | B2 | 3/2016 | Kim | |
| 9,339,993 | B2 | 5/2016 | Cites | |
| 9,476,633 | B2 | 10/2016 | Allard | |
| 9,500,402 | B2 | 11/2016 | Kim | |
| 9,528,748 | B2 * | 12/2016 | Joo | F25D 23/02 |
| 9,702,621 | B2 * | 7/2017 | Cho | F25D 23/028 |
| 9,810,475 | B2 | 11/2017 | Kim | |
| 9,890,990 | B2 | 2/2018 | Allard | |
| 10,317,128 | B2 | 6/2019 | Son et al. | |
| 10,670,320 | B2 | 6/2020 | Lee et al. | |
| 2004/0194253 | A1 | 10/2004 | Jung | |
| 2005/0006997 | A1 | 1/2005 | Yoshioka | |
| 2006/0265960 | A1 | 11/2006 | Leimkuehler | |
| 2007/0188059 | A1 | 8/2007 | Davis et al. | |
| 2008/0042537 | A1 * | 2/2008 | Kim | F25D 23/085 312/405 |
| 2008/0143227 | A1 * | 6/2008 | Kim | F25D 23/02 312/405 |
| 2009/0045705 | A1 * | 2/2009 | Laible | A47B 96/20 312/204 |
| 2010/0295425 | A1 | 11/2010 | Kim | |
| 2011/0025173 | A1 | 2/2011 | Ciyanoglu | |
| 2012/0073202 | A1 | 3/2012 | Lee et al. | |
| 2012/0169196 | A1 * | 7/2012 | Marchetti | E06B 3/721 312/265.6 |
| 2013/0323461 | A1 * | 12/2013 | Shim | F25D 23/02 428/121 |
| 2014/0132146 | A1 | 5/2014 | Kim et al. | |
| 2015/0115782 | A1 | 4/2015 | Resch | |
| 2015/0145399 | A1 | 5/2015 | Joo | |
| 2015/0159936 | A1 | 6/2015 | Oh et al. | |
| 2015/0192353 | A1 | 7/2015 | Lee | |
| 2016/0061511 | A1 | 3/2016 | Park | |
| 2016/0117022 | A1 | 4/2016 | Kim | |
| 2016/0178277 | A1 | 6/2016 | Park | |
| 2016/0209110 | A1 | 7/2016 | Cho | |
| 2016/0305706 | A1 * | 10/2016 | Lim | F25D 23/04 |
| 2016/0334158 | A1 | 11/2016 | Joo | |
| 2016/0341468 | A1 | 11/2016 | Joo et al. | |
| 2016/0370052 | A1 * | 12/2016 | Yang | F25C 5/22 |
| 2017/0082349 | A1 | 3/2017 | Jung | |
| 2017/0191744 | A1 | 7/2017 | Koo | |
| 2017/0343273 | A1 | 11/2017 | Cheon | |
| 2017/0370631 | A1 * | 12/2017 | Kim | F25D 23/028 |
| 2018/0038626 | A1 | 2/2018 | Kim | |
| 2018/0087827 | A1 | 3/2018 | Lee | |
| 2018/0141718 | A1 | 5/2018 | Ahlström | |
| 2018/0142941 | A1 | 5/2018 | Arslankiray | |
| 2018/0156529 | A1 | 6/2018 | Wantland et al. | |
| 2018/0172337 | A1 | 6/2018 | Choi | |
| 2018/0187951 | A1 | 7/2018 | Seo | |
| 2018/0187955 | A1 | 7/2018 | Son | |
| 2018/0223582 | A1 | 8/2018 | Shin | |
| 2018/0231299 | A1 | 8/2018 | Koo | |
| 2018/0274846 | A1 | 9/2018 | Kim | |
| 2018/0283768 | A1 * | 10/2018 | Raab | F25D 23/028 |
| 2018/0292127 | A1 | 10/2018 | Park | |
| 2018/0320952 | A1 | 11/2018 | Joo et al. | |
| 2019/0024962 | A1 | 1/2019 | Lee | |
| 2019/0053685 | A1 | 2/2019 | Chwalibog | |
| 2019/0120547 | A1 | 4/2019 | Staud | |
| 2019/0145140 | A1 | 5/2019 | Zhang | |
| 2020/0072544 | A1 | 3/2020 | Lee | |
| 2020/0284503 | A1 | 9/2020 | Gerstmayr | |
| 2020/0326119 | A1 | 10/2020 | Lee | |

FOREIGN PATENT DOCUMENTS

| | | | | |
|---|---|---|---|---|
| CN | 1576757 | A | 2/2005 | |
| CN | 201225804 | Y | 4/2009 | |
| CN | 201731722 | U | 2/2011 | |
| CN | 104457115 | A | 3/2015 | |
| CN | 204 478 688 | U | 7/2015 | |
| CN | 205860639 | U | 1/2017 | |
| CN | 106 802 056 | A | 6/2017 | |
| CN | 107328161 | A | 11/2017 | |
| CN | 107677035 | | 2/2018 | |
| CN | 207299701 | U | 5/2018 | |
| CN | 109 974 369 | A | 7/2019 | |
| DE | G 93 02 426.6 | U1 | 6/1994 | |
| DE | 10 2007 021 557 | A1 | 11/2008 | |
| DE | 10 2008 019 421 | A1 | 10/2009 | |
| DE | 21 2015 000 209 | U1 | 5/2017 | |
| DE | 10 2017 213 909 | A1 | 2/2019 | |
| EP | 0647821 | A1 * | 4/1995 | F25D 23/02 |
| EP | 1 477 753 | A1 | 11/2004 | |
| EP | 2 730 869 | A2 | 5/2014 | |
| EP | 2 843 330 | A2 | 3/2015 | |
| EP | 2843329 | A2 * | 3/2015 | F25D 23/028 |
| EP | 2 843 330 | A3 | 11/2015 | |
| EP | 3 147 605 | A1 | 3/2017 | |
| EP | 3 441 704 | A1 | 2/2019 | |
| EP | 3 147 605 | A1 | 3/2019 | |
| GB | 1 038 499 | A | 8/1966 | |
| GB | 2 186 311 | A | 8/1987 | |
| JP | S45-1490 | Y1 | 1/1970 | |
| JP | 55-10981 | | 1/1980 | |
| JP | 6-312464 | | 11/1994 | |
| JP | 07-022382 | U | 4/1995 | |
| JP | 2000-146422 | A | 5/2000 | |
| JP | 2014-231974 | A | 12/2014 | |
| JP | 2016-156556 | | 9/2016 | |
| KR | 20-0319637 | Y1 | 7/2003 | |
| KR | 2003-0057087 | | 7/2003 | |
| KR | 10-2003-0084071 | A | 11/2003 | |
| KR | 2003-0084071 | | 11/2003 | |
| KR | 10-0432749 | | 5/2004 | |
| KR | 10-0432749 | B | 5/2004 | |
| KR | 10-2005-0099051 | A | 10/2005 | |
| KR | 1020050104119 | A | 11/2005 | |
| KR | 10-0634365 | B1 | 10/2006 | |
| KR | 10-2007-0008823 | A | 1/2007 | |
| KR | 10-0678674 | | 2/2007 | |
| KR | 10-0678674 | B1 | 2/2007 | |
| KR | 10-2007-0068933 | | 7/2007 | |
| KR | 10-2007-0068933 | A | 7/2007 | |
| KR | 10-0751015 | | 8/2007 | |
| KR | 10-0751015 | B | 8/2007 | |
| KR | 10-2008-0057471 | A | 6/2008 | |
| KR | 10-0861352 | | 10/2008 | |
| KR | 10-0864724 | | 10/2008 | |
| KR | 100864724 | B1 | 10/2008 | |
| KR | 10-0877989 | | 1/2009 | |
| KR | 10-2010-0057246 | | 5/2010 | |
| KR | 10-2010-0057246 | A | 5/2010 | |
| KR | 10-2012-0039618 | | 4/2012 | |
| KR | 10-2013-0053549 | | 5/2013 | |
| KR | 10-1307862 | | 9/2013 | |
| KR | 10-1367034 | | 3/2014 | |
| KR | 10-1367034 | B1 | 3/2014 | |
| KR | 10-2014-0060431 | A | 5/2014 | |
| KR | 10-1520691 | | 5/2015 | |
| KR | 10-2015-0061213 | | 6/2015 | |
| KR | 10-2015-0061213 | A | 6/2015 | |

(56) References Cited

FOREIGN PATENT DOCUMENTS

| | | | |
|---|---|---|---|
| KR | 10-2015-0082063 | A | 7/2015 |
| KR | 10-2017-0093994 | | 8/2017 |
| KR | 10-2017-0093994 | A | 8/2017 |
| KR | 10-2018-0022232 | A | 3/2018 |
| KR | 10-1895086 | | 9/2018 |
| RU | 1778471 | A1 | 11/1992 |
| RU | 2259520 | C2 | 8/2005 |
| RU | 2432533 | C2 | 10/2011 |
| RU | 2449228 | C2 | 4/2012 |
| RU | 2478174 | C2 | 3/2013 |
| RU | 2553249 | C2 | 6/2015 |
| RU | 2636160 | C1 | 11/2017 |
| WO | WO 2004/104502 | A1 | 12/2004 |
| WO | WO 2009/114706 | A1 | 9/2009 |
| WO | WO 2010/141980 | A1 | 12/2010 |
| WO | WO 2017/007164 | A1 | 1/2017 |
| WO | WO 2017/119614 | A1 | 7/2017 |

OTHER PUBLICATIONS

Korean Office Action dated May 10, 2021, in corresponding Korean Patent Application No. 10-2020-0063401.
Extended European Search Report dated Jun. 21, 2021, in corresponding European Patent Application No. 21159518.6.
Communication pursuant to Article 94(3) EPC dated Jul. 15, 2021, in corresponding European Patent Application No. 20 208 096.6.
Extended European Search Report dated Jun. 22, 2021, in corresponding European Patent Application No. 21159524.4.
Korean Office Action dated Jun. 29, 2021, in corresponding Korean Patent Application No. 10-2021-0074588.
Office Action dated Jun. 18, 2021, in in co-pending U.S. Appl. No. 16/998,908.
Non Final Action issued in U.S. Appl. No. 16/950,673 dated Aug. 31, 2021.
Non-Final Rejection issued in U.S. Appl. No. 16/950,678 dated Aug. 19, 2021.
Non-Final Rejection issued in U.S. Appl. No. 16/950,682 dated Aug. 19, 2021.
Non-Final Rejection issued in U.S. Appl. No. 16/950,773 dated Sep. 1, 2021.
English translation of JP2014231974A; Dec. 11, 2014**.
Office Action dated May 5, 2021, in co-pending U.S. Appl. No. 17/099,627.
Notice of Allowance dated May 13, 2021, in in co-pending U.S. Appl. No. 17/184,970.
International Search Report dated Apr. 28, 2021, in corresponding International Patent Application No. PCT/KR2021/001068.
International Search Report dated Jul. 23, 2020 in connection with International Patent Application No. PCT/KR2020/004544, 3 pages.
Korean Office Action dated Dec. 21, 2020, in corresponding Korean Patent Application No. 10-2019-0086074.
Korean Request for Accelerated Examination dated Nov. 6, 2020, in corresponding Korean Patent Application No. 10-2019-0086074.
Korean Office Action dated Jan. 24, 2021, in corresponding Korean Patent Application No. 10-2020-0154211.
Korean Office Action dated Jun. 29, 2021, in Korean Patent Application No. 10-2021-0077565.
Extended European Search Report dated Apr. 20, 2021, in corresponding European Patent Application No. 20208048.7-1009.
Extended European Search Report dated Mar. 22, 2021, in corresponding European Patent Application No. 20208034.7-1009.
Extended European Search Report dated Mar. 19, 2021, in corresponding European Patent Application No. 20208041.2-1009.
Extended European Search Report dated Mar. 22, 2021, in corresponding European Patent Application No. 20208102.2-1009.
Extended European Search Report dated Mar. 23, 2021, in corresponding European Patent Application No. 20208110.5-1009.
Extended European Search Report dated Mar. 22, 2021 issued in corresponding European Patent Application No. 20208115.4-1009.
Notice of Preliminary Rejection dated Jan. 12, 2021 issued in corresponding Korean Patent Application No. 10-2020-0152722.
International Search Report dated Dec. 15, 2020 in corresponding International Patent Application No. PCT/KR2020/010518.
Notice of Allowance dated Mar. 10, 2021 in copending U.S. Appl. No. 16/950,663.
Office Action dated Apr. 1, 2021 in copending U.S. Appl. No. 17/171,337.
Notice of Allowance dated Apr. 16, 2021 in copending U.S. Appl. No. 17/171,337.
Notice of Allowance dated Apr. 15, 2021, in copending U.S. Appl. No. 17/184,970.
U.S. Appl. No. 17/184,970, filed Feb. 25, 2021, Sungdeuk Park, Samsung Electronics Co., Ltd..
U.S. Appl. No. 17/171,337, filed Feb. 9, 2021, Chomin Lee, Samsung Electronics Co., Ltd..
U.S. Appl. No. 16/950,663, filed Nov. 17, 2020, Chomin Lee, Samsung Electronics Co., Ltd..
U.S. Appl. No. 16/998,908, filed Aug. 20, 2020, Chomin Lee, Samsung Electronics Co., Ltd..
U.S. Appl. No. 16/950,682, filed Nov. 17, 2020, Chomin Lee, Samsung Electronics Co., Ltd..
U.S. Appl. No. 16/950,673, filed Nov. 17, 2020, Chomin Lee, Samsung Electronics Co., Ltd..
U.S. Appl. No. 16/950,678, filed Nov. 17, 2020, Chomin Lee, Samsung Electronics Co., Ltd..
U.S. Appl. No. 17/185,384, filed Feb. 25, 2021, Sungdeuk Park, Samsung Electronics Co., Ltd..
U.S. Appl. No. 16/950,773, filed Nov. 17, 2020, Sungdeuk Park, Samsung Electronics Co., Ltd..
Final Office Action issued in U.S. Appl. No. 16/998,908 dated Oct. 13, 2021.
Non Final Office Action issued in U.S. Appl. No. 17/099,627 dated Oct. 28, 2021.
U.S. Appl. No. 17/502,677, filed Oct. 15, 2021, Chomin Lee, Samsung Electronics Co., Ltd..
Non-Final Rejection issued in U.S. Appl. No. 17/099,661 dated Oct. 4, 2021.
Non-Final Rejection issued in U.S. Appl. No. 17/099,689 dated Oct. 4, 2021.
U.S. Appl. No. 17/480,854, filed Sep. 21, 2021, Chomin Lee, Samsung Electronics Co., Ltd..
U.S. Appl. No. 17/474,576, filed Sep. 14, 2021, Chomin Lee, Samsung Electronics Co., Ltd..
U.S. Appl. No. 17/474,594, filed Sep. 14, 2021, Chomin Lee, Samsung Electronics Co., Ltd..
U.S. Appl. No. 17/480,388, filed Sep. 21, 2021, Sungdeuk Park, Samsung Electronics Co., Ltd..
Extended European Search Report dated Oct. 1, 2021, in corresponding European Patent Application No. 21180812.6.
Extended European Search Report dated Oct. 1, 2021, in corresponding European Patent Application No. 21180820.9.
Chinese Office Action dated Oct. 9, 2021, in corresponding Chinese Patent Application No. 202110250149.5.
Extended European Search Report dated Dec. 2, 2021, in corresponding European Patent Application No. 21701195.6.
Office Action issued in U.S. Appl. No. 17/502,677 dated Dec. 2, 2021.
Notice of Allowance issued in U.S. Appl. No. 16/950,673 dated Dec. 8, 2021.
Office Action issued in U.S. Appl. No. 17/474,576 dated Dec. 7, 2021.
Office Action issued in U.S. Appl. No. 17/474,594 dated Dec. 7, 2021.
Notice of Allowance issued in U.S. Serial No. 16/950,773 dated Dec. 10, 2021.
Notice of Allowance issued in U.S. Appl. No. 17/185,384 dated Jan. 4, 2022.
Office Action issued in U.S. Appl. No. 17/480,854 dated Jan. 6, 2022.
Advisory Action issued in U.S. Appl. No. 16/998,908 dated Jan. 19, 2022.
Office Action issued in U.S. Appl. No. 16/950,678 dated Jan. 18, 2022.

(56) References Cited

OTHER PUBLICATIONS

Search Report dated Dec. 6, 2021, in corresponding Russian Patent Application No. 2021104790.
Notice of Allowance dated Dec. 7, 2021, in corresponding Russian Patent Application No. 2021104790.
Search Report dated Dec. 10, 2021, in corresponding Russian Patent Application No. 2021104602.
Notice of Allowance dated Dec. 10, 2021, in corresponding Russian Patent Application No. 2021104602.
Search Report dated Dec. 13, 2021, in corresponding Russian Patent Application No. 2021104792.
Chinese Office Action dated Dec. 16, 2021, in corresponding Chinese Patent Application No. 202080004419.8.
Chinese Office Action dated Dec. 27, 2021, in corresponding Chinese Patent Application No. 202080004516.7.
Chinese Office Action dated Jan. 20, 2022, in corresponding Chinese Patent Application No. 202110684887.0.
Notice of Allowance issued in U.S. Appl. No. 16/950,682 dated Jan. 21, 2022.
Notice of Allowance issued in U.S. Appl. No. 17/099,661 dated Jan. 26, 2022.
Notice of Allowance issued in U.S. Appl. No. 17/480,388 dated Jan. 26, 2022.
Corrected Notice of Allowability issued in U.S. Appl. No. 16/950,773 dated Jan. 19, 2022.
Corrected Notice of Allowability issued in U.S. Appl. No. 16/950,773 dated Feb. 2, 2022.
Corrected Notice of Allowability issued in U.S. Appl. No. 17/185,384 dated Jan. 28, 2022.
Corrected Notice of Allowability issued in U.S. Appl. No. 16/950,673 dated Jan. 18, 2022.
Corrected Notice of Allowability issued in U.S. Appl. No. 16/950,673 dated Jan. 28, 2022.
Notice of Allowability issued in U.S. Appl. No. 16/950,682 dated Feb. 2, 2022.
Office Action issued in U.S. Appl. No. 16/998,908 dated Feb. 11, 2022.
Notice of Allowance issued in U.S. Appl. No. 17/480,854 dated Mar. 7, 2022.

* cited by examiner

REFRIGERATOR

CROSS-REFERENCE TO RELATED APPLICATION

This application is based on and claims priority under 35 U.S.C. § 119 to Korean Patent Application No. 10-2019-0043937 filed on Apr. 15, 2019 and Korean Patent Application No. 2019-0086074 filed on Jul. 17, 2019 in the Korean Intellectual Property Office, the disclosures of which are herein incorporated by reference in their entirety.

BACKGROUND

1. Field

The disclosure relates to a refrigerator, and more specifically, to a refrigerator having an improved structure of a door.

2. Description of the Related Art

In general, a refrigerator represents a household appliance provided with a main body including a storage compartment and a cool air supply system to store foods in a fresh state. The storage compartment includes a refrigerating compartment for keeping foods refrigerated at about 0° C. and a freezing compartment for keeping foods frozen at about 30° C. In general, the storage compartment has a front surface thereof open such that food items are introduced and withdrawn therethrough, and the open front surface of the storage compartment is opened and closed by a door.

The refrigerator, according to the storage compartment and a door thereof, may be classified into different types: a top mounted freezer (TMP)-type refrigerator provided with a storage compartment that is divided into an upper side and a lower side by a horizontal partition while a freezing compartment is formed at the upper side and a refrigerating compartment is formed at the lower side; and a bottom mounted freezer (BMF)-type refrigerator provided with a refrigerating compartment formed at the upper side while a freezing compartment is formed at the lower side. In addition, a side by side (SBS)-type refrigerator is provided therein with a storage compartment that is divided into an left side and a right side by a vertical partition while a freezing compartment is formed at one side and a refrigerating compartment is formed at the other side, and a French door refrigerator (FDR)-type refrigerator is provided therein with a storage compartment that is divided into an upper side and a lower side by a horizontal partition while a refrigerating compartment is formed at the upper side and a freezing compartment is formed at the lower side, as the refrigerating compartment at the upper side is opened/closed by a pair of doors.

SUMMARY

Therefore, it is an object of the disclosure to provide a refrigerator in which a door panel of a door is replaceable.

Additional aspects of the disclosure will be set forth in part in the description which follows and, in part, will be obvious from the description, or may be learned by practice of the disclosure.

Therefore, it is an aspect of the disclosure to provide a refrigerator including: a main body forming a storage compartment; and door provided to open and close the storage compartment, herein the door includes: a door frame; a cover arranged in front of the door frame and including a cover fixer; and a door panel arranged in front of the cover, the door panel including a first fixer and a second fixer on a rear surface of the door panel, herein when the door panel is coupled to a front side of the cover, the first fixer is coupled to the door frame and the second fixer is coupled to the cover.

The first fixer may be provided to be screw-coupled to the door frame, and the second fixer may be provided to be hook-coupled to the cover fixer.

The first fixer may include a locking protrusion, and the door frame may include a frame accommodation groove in which the locking protrusion is accommodated when the door frame is coupled to the door panel.

The cover fixer may include an accommodation space recessed in a direction of a lower rear side of the cover fixer, the second fixer may include a hook that is provided to be inserted into the accommodation space, and the hook may include a coupling guide part provided at a front end thereof in a direction of being inserted into the accommodation space and sloping in the direction of the lower rear side of the cover fixer.

The door frame may include: chassis forming a left side surface and a right side surface of the door; an upper door cap including a material different from a material of the chassis and coupled to an upper end of the chassis; and a lower door cap including a material different from the material of the chassis and coupled to a lower end of the chassis.

The door panel may further include a panel body and an edge cover disposed at an upper end of the panel body; and the edge cover may be provided to cover at least a portion of an edge of the panel body together with the chassis and the lower door cap when the door panel is coupled to the cover and the door frame.

The lower door cap may include a drainage hole that communicates a space between the door panel and the cover with an outside of the door.

A gap may be formed between the lower door cap and the door panel, and the lower door cap may include a drainage guide part sloping downward toward the gap.

The door frame may include an edge accommodation groove positioned to correspond to an end portion of the door panel and recessed toward a rear side to accommodate the end portion of the door panel.

The cover may further include a cover body provided with a mounting hole in which the cover fixer is mounted and a guide rib forming a portion of an edge of the mounting hole, and the cover fixer may include a guide protrusion that is provided to be coupled to the guide rib when the cover fixer is slidingly mounted to the cover body.

The cover may further include a guide bead formed at an outer side of a periphery of the mounting hole, the guide bead configured to guide a sliding motion of the cover fixer when the cover fixer is mounted to the cover body.

The cover fixer may include a stopper provided to be caught with the mounting hole to prevent the cover fixer from being separated after the cover fixer is mounted to the cover body.

The cover may further include a mounting hole and a mounting protrusion protruding from at least a portion of an edge of the mounting hole, and the cover fixer may include a coupling protrusion provided to be coupled to the mounting protrusion.

The door panel may further include a buffer member arranged on one surface of the door panel facing the cover, and the buffer member may be provided to form a flow path in a space between the door panel and the cover.

The door frame may include a fixing protrusion and, the cover may further include a plate bead formed on one end portion thereof to be coupled to the fixing protrusion.

It is another aspect of the disclosure to provide a refrigerator including: a main body forming a storage compartment; and a door provided to open and close the storage compartment, wherein the door includes: chassis forming a left side surface and a right side surface of the door; an upper door cap coupled to an upper end of the chassis; a lower door cap coupled to a lower end of the chassis; a cover covering a front of, the chassis, the upper door cap, and the lower door cap; and a door panel provided to cover a front of the cover and including a panel body, and an edge cover arranged at an end portion of the panel body to cover at least a portion of an edge of the panel body while covering the cover.

The door panel may further include a buffer member arranged on one surface of the door panel facing the cover, the buffer member may be provided to form a flow path in a space between the door panel and the cover.

Each of the chassis may include an edge accommodation groove positioned to correspond to an end portion of the door panel and recessed in a coupling direction of the door panel to accommodate the end portion of the door panel.

The door panel may further include: a first fixer detachably coupled to the upper door cap; and a second fixer detachably coupled to the cover and having a structure different from a structure of the first fixer.

It is another aspect of the disclosure to provide a refrigerator including: a refrigerator including: a main body forming a storage compartment; and a door provided to open and close the storage compartment, wherein the door includes: a door frame; a cover arranged in front of the door frame and including a cover body and a cover fixer detachably coupled to the cover body; a door panel provided to cover a front of the cover, and the door panel including a first fixer detachably coupled to the door frame and a second fixer detachably coupled to the cover fixer, wherein the cover fixer includes an accommodation space recessed in a direction of a lower rear side of the cover fixer, wherein the second fixer includes a hook that is provided to be inserted into the accommodation space, and wherein the hook has a coupling guide part provided at a front end thereof in a direction of being inserted into the accommodation space and sloping in the direction of the lower rear side of the cover fixer.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
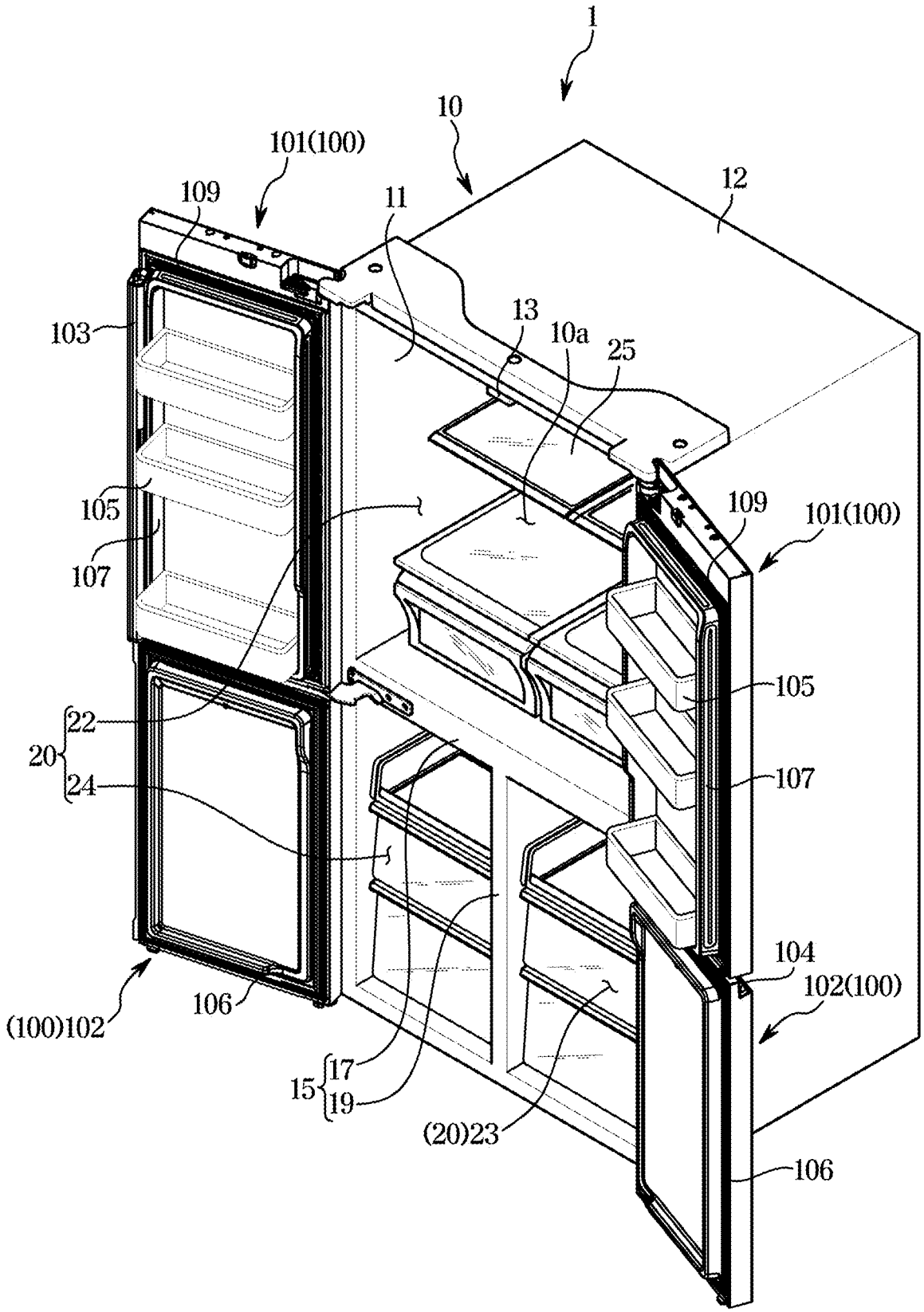
FIG. 1 is a view illustrating a refrigerator according to an embodiment of the disclosure.

FIGS. 1 through 24, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~and/or ~," or the like.

The terms "front", "rear", "upper", "lower", "left", and "right" as herein used are defined with respect to the drawings, but the terms may not restrict the shape and position of the respective components.

Hereinafter, with reference to the accompanying drawings an embodiment according to the disclosure will be described in detail.

FIG. 1 is a view illustrating a refrigerator 1 according to an embodiment of the disclosure.

Referring to FIG. 1, the refrigerator 1 includes a main body 10, a storage compartment 20 divided into an upper side and a lower side in the main body 10, a door 100 opening and closing the storage compartment 20, and a cold air supply device (not shown) supplying cold air to the storage compartment 20.

The main body 10 includes an inner case 11 forming the storage compartment 20, an outer case 12 coupled to an outer side of the inner case 11 to form the external appearance thereof, and a body heat insulating material foamed between the inner case 11 and the outer case 12 to insulate the storage compartment 20.

The cold air supply device may generate cold air using a refrigeration cycle that compresses, condenses, expands, and evaporates a refrigerant.

The storage compartment 20 may be divided into a plurality of areas by a partition 15, and may be provided with a plurality of shelves 25 and receptacles 26 therein to store food items and the like.

The storage compartment 20 may be divided into a plurality of storage compartments 22, 23, and 24 by the partition 15, and the partition 15 includes a first partition 17 horizontally coupled to the interior of the storage compartment 20 to divide the storage compartment 20 into an upper storage compartment (or a first storage 22) and lower storage compartments 23 and 24, and a second partition 19 vertically coupled to the lower storage compartments 23 and 24 to divide the lower storage compartments 23 and 24 as a second storage compartment 23 and a third storage compartment 24.

The partition 15 having a T-shape formed of the first partition 17 and the second partition 19 coupled thereto may divide the storage compartment 20 into three spaces. Among the upper storage compartment 22 and the lower storage compartments 23 and 24 divided by the first partition 17, the upper storage compartment 22 may be used as a refrigerating compartment, and the lower storage compartments 23 and 24 may be used as a freezing compartment.

The lower storage compartments 23 and 24 may be used as freezing compartments as a whole. The second storage compartment 23 may be used as a freezing compartmenting, and the third storage compartment 24 may be used as a freezing compartment. The second storage compartment 23 may be used as a freezing compartment, and the third storage compartment 24 may be used as both a freezing compartment and a refrigerating compartment.

The division of the storage compartment 20 described above is merely an example, and each of the storage compartments 22, 23, and 24 may be used differently from the above description.

The storage compartment 20 may be opened and closed by the door 100. The door 100 includes a pair of first doors (or upper doors 101) for opening and closing the upper storage compartment 22 and a pair of second doors (or lower doors) 102 for opening and closing the lower storage compartment 23 and 24. The pair of first doors 101 and the pair of second doors 102 may open and close a body opening 10*a* of the main body 10.

One of the pair of first doors 101 may be provided with a rotating bar 103. The rotating bar 103 may seal a gap between the pair of first doors 101 when the pair of first doors 101 are closed. The main body 10 may be provided with a rotating bar guide 13 for guiding the movement of the rotating bar 103.

In the following description, one first door 101 is described for the convenience of description, and the description of the remaining first door 101 is omitted. However, the configuration of the first door 101, which is not described below, may be substantially the same as that of the first door 101 described below, except that the first door 101 is provided in mutual mirror symmetry with the first door 101 described below. In addition, the same configuration as that of the first door 101 may be applied to the second door 102, and a detailed description thereof may be omitted.

The upper storage compartment 22 may be opened and closed by the first door 101 rotatably coupled to the main body 10. The first door 101 may be opened or closed through a first door handle (not shown). The first door handle may be a recess formed in the bottom surface of the first door 101.

A first door shelf 105 may be provided on the rear surface of the first door 101 to accommodate food. The first door shelf 105 includes first shelf support parts 107 arranged on both left and right sides of the first door 101 while vertically extending to support the first door shelf 105. The first shelf support part 107 may be provided to be detachably provided on the first door 101 as a separate component. In this embodiment, the first shelf support part 107 protrudes backward from the rear surface of the first door 101 while extending in the vertical direction.

A first gasket 109 may be provided at the edge of the rear surface of the first door 101 to seal a gap with respect to the main body 10 when the first door 101 is closed. The first gasket 109 may be installed in the form of a loop along the edge of the rear surface of the first door 101, and a first magnet (not shown) may be included in the first gasket 109.

The lower storage compartments 23 and 24 may be opened and closed by the second doors 102 rotatably coupled to the main body 10. The second door 102 may be opened or closed through a second door handle 104. The second door handle 104 may be a recess formed in the upper surface of the second door 102. Although not shown, the second door 102 may be provided in a sliding manner.

A second gasket 106 may be provided at an edge of the rear surface of the second door 102 to seal a gap with respect to the main body 10 while the second door 102 is closed. The second gasket 106 may be installed in a loop shape along the edge of the rear surface of the second door 102, and a second magnet (not shown) may be included in the second gasket 106.

Figure 2:
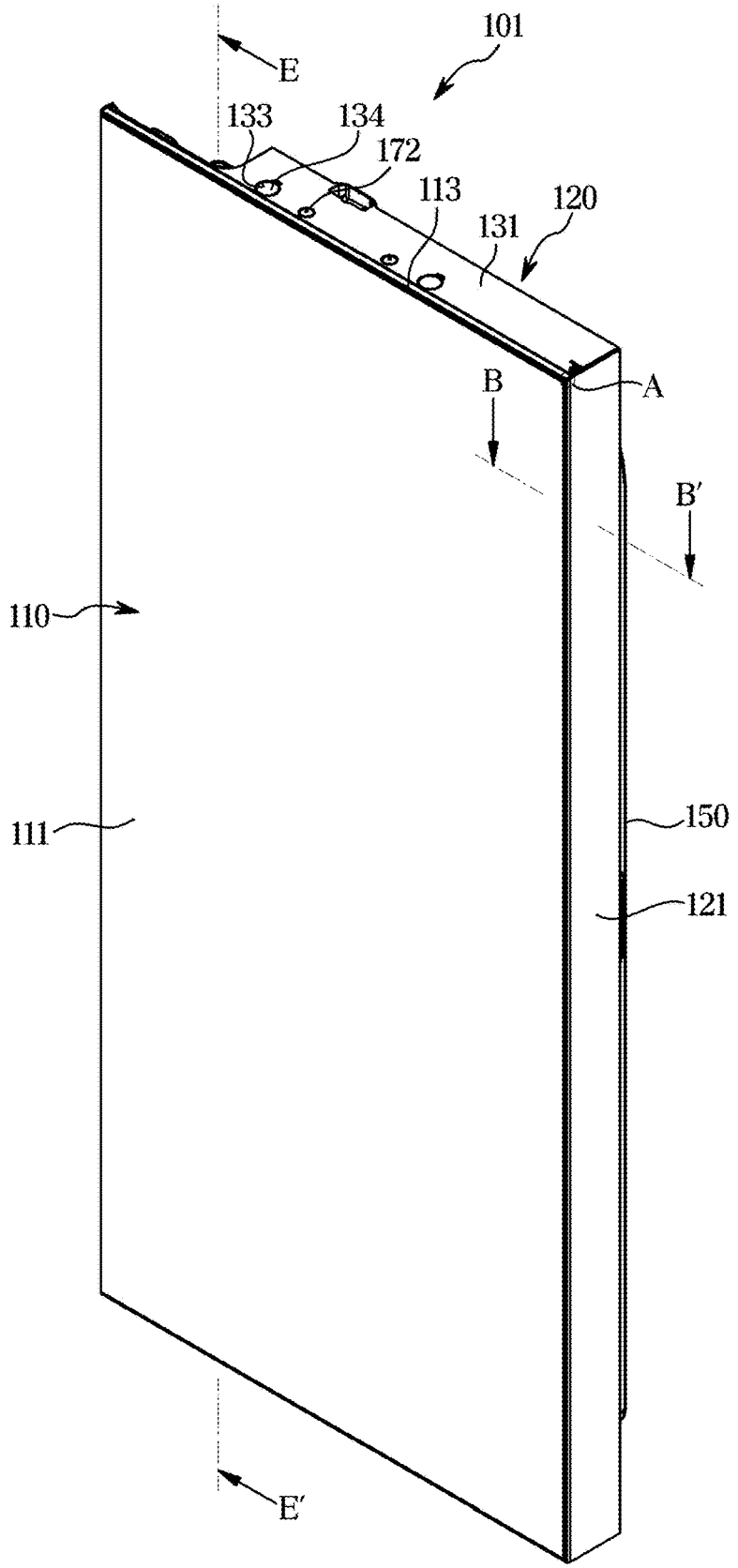
FIG. 2 is a view illustrating a first door shown in FIG. 1.
Figure 3:
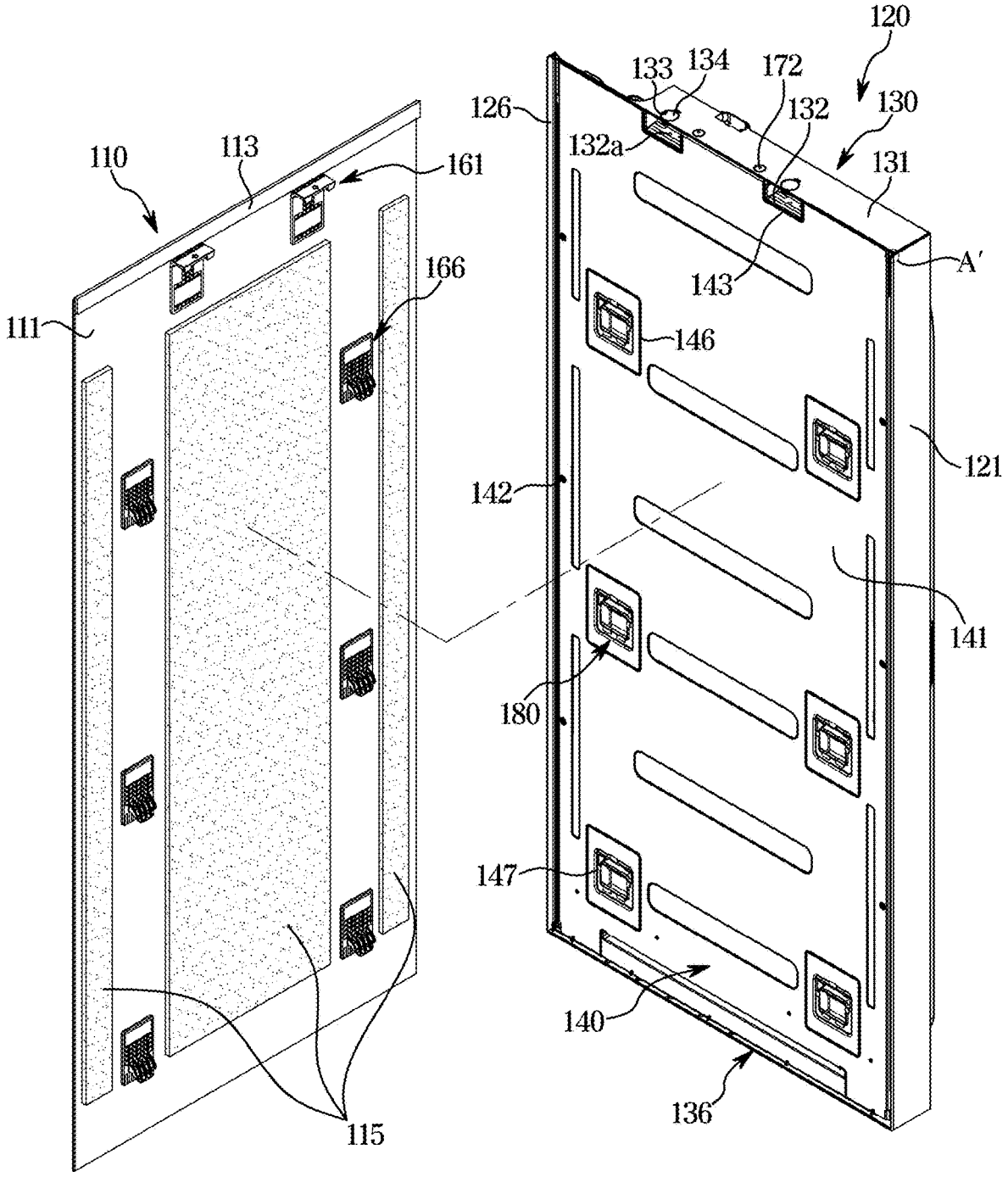
FIG. 3 is an exploded view illustrating a state in which a door panel is dissembled from the first door shown in FIG. 2.
Figure 4:
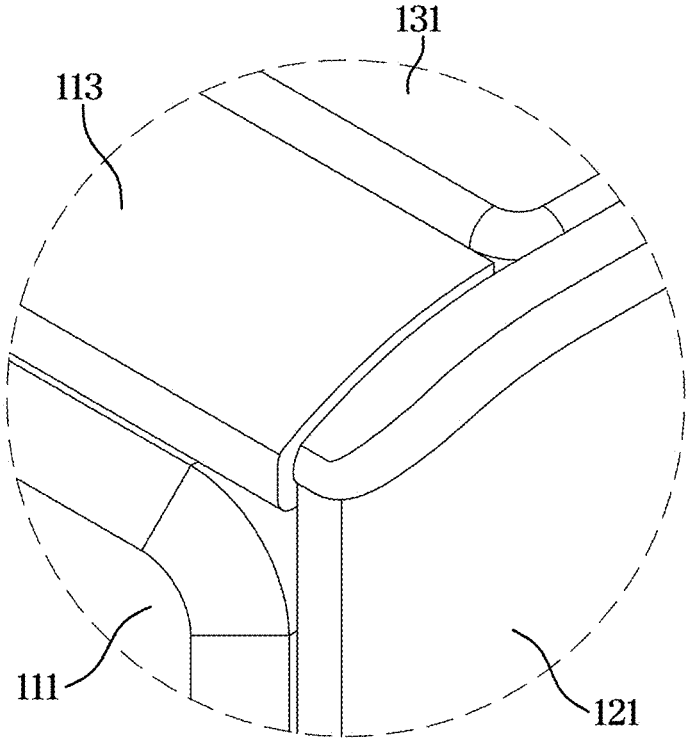
FIG. 4 is an enlarged view illustrating portion A of in FIG. 2.
Figure 5:
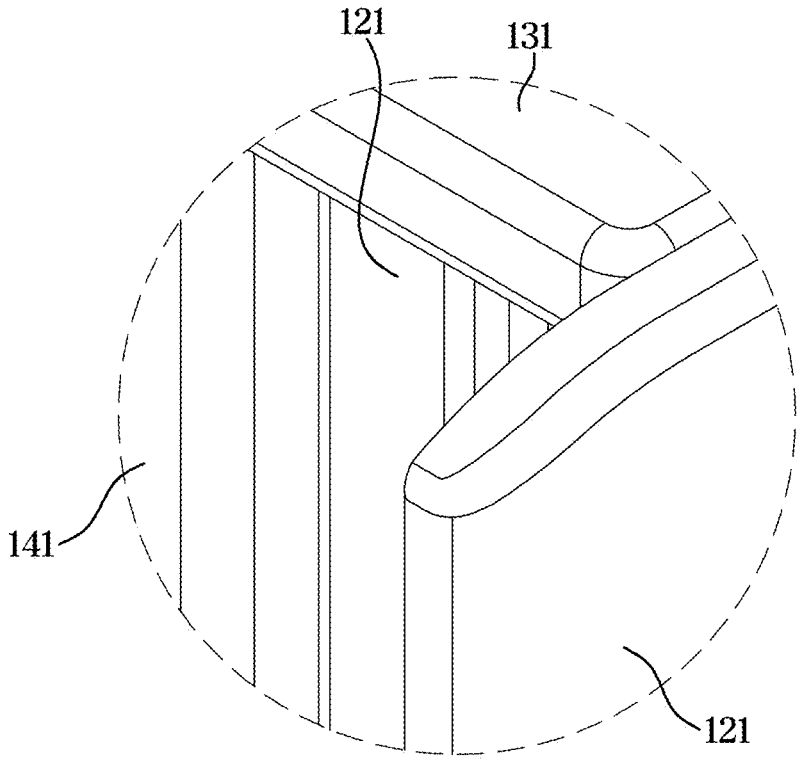
FIG. 5 is an enlarged view illustrating portion A' of in FIG. 3.
Figure 6:
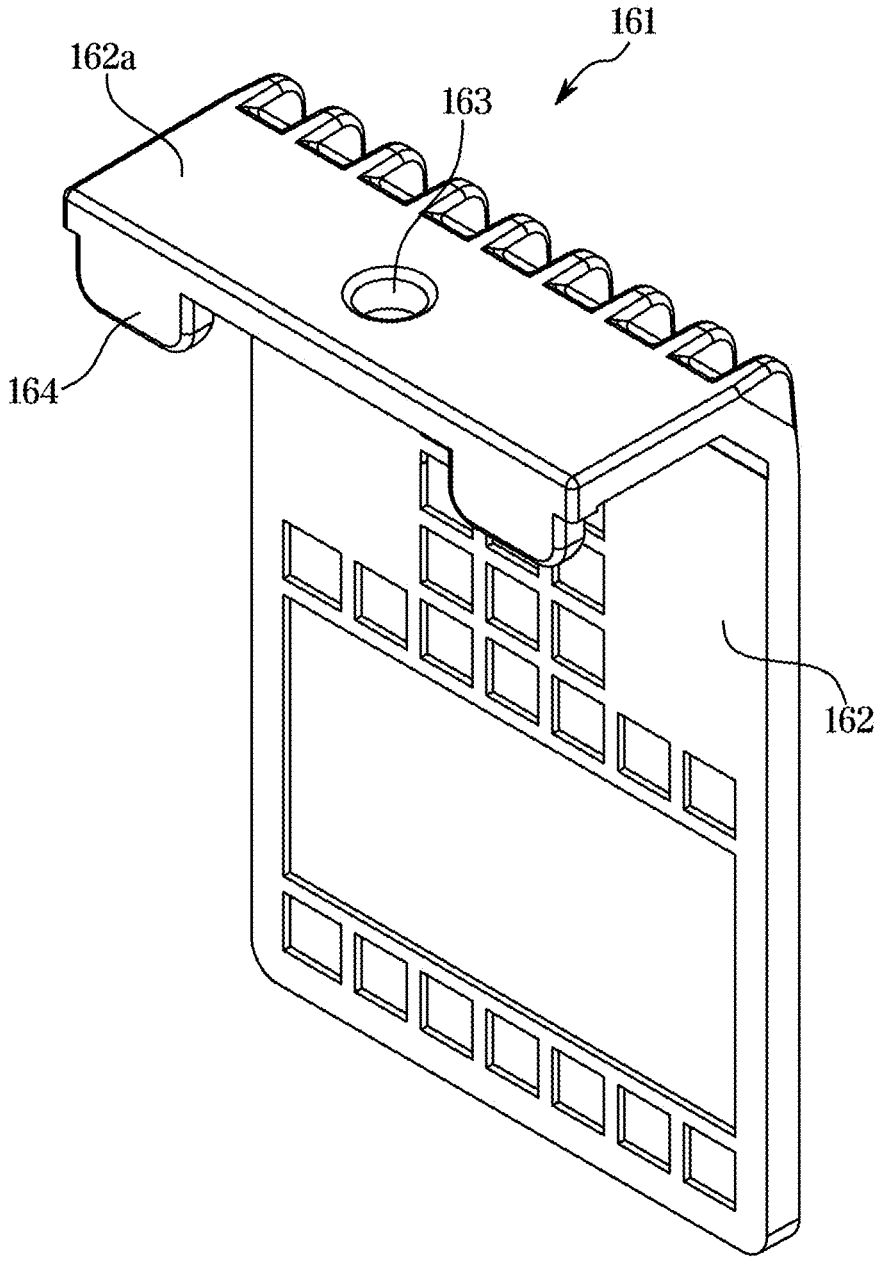
FIG. 6 is a view illustrating a first fixer shown in FIG. 3.
Figure 7:
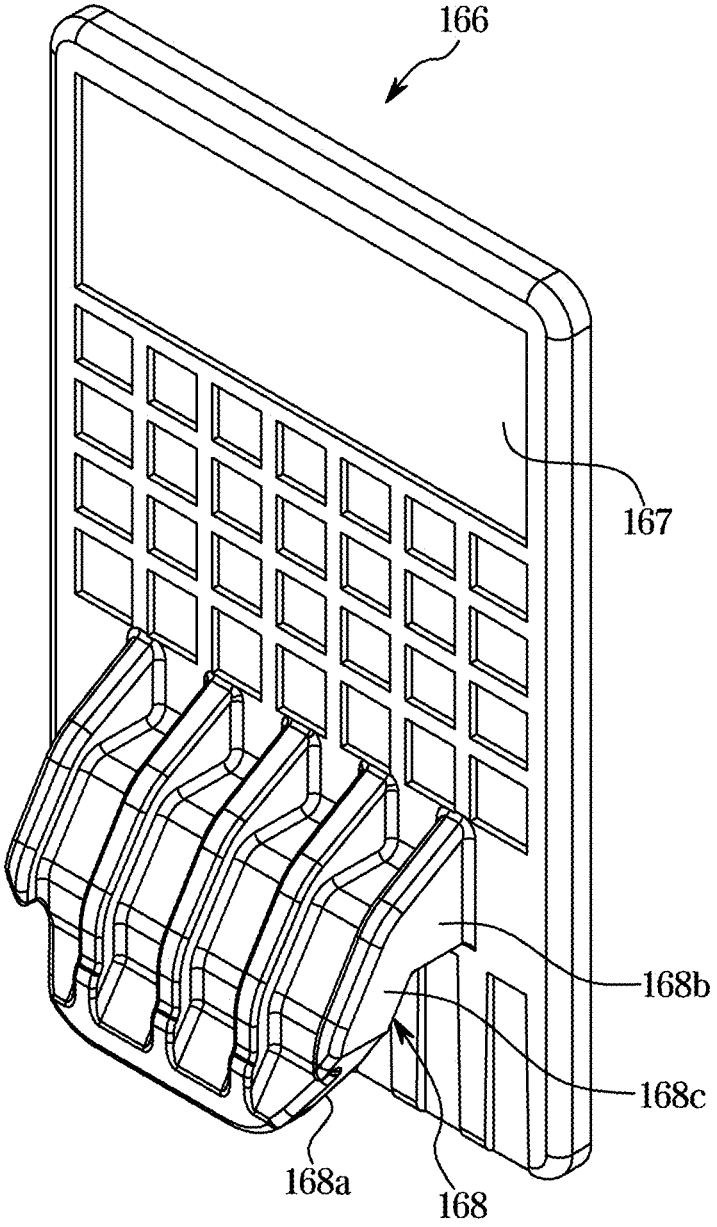
FIG. 7 is a view illustrating a second fixer shown in FIG. 3.
Figure 8:
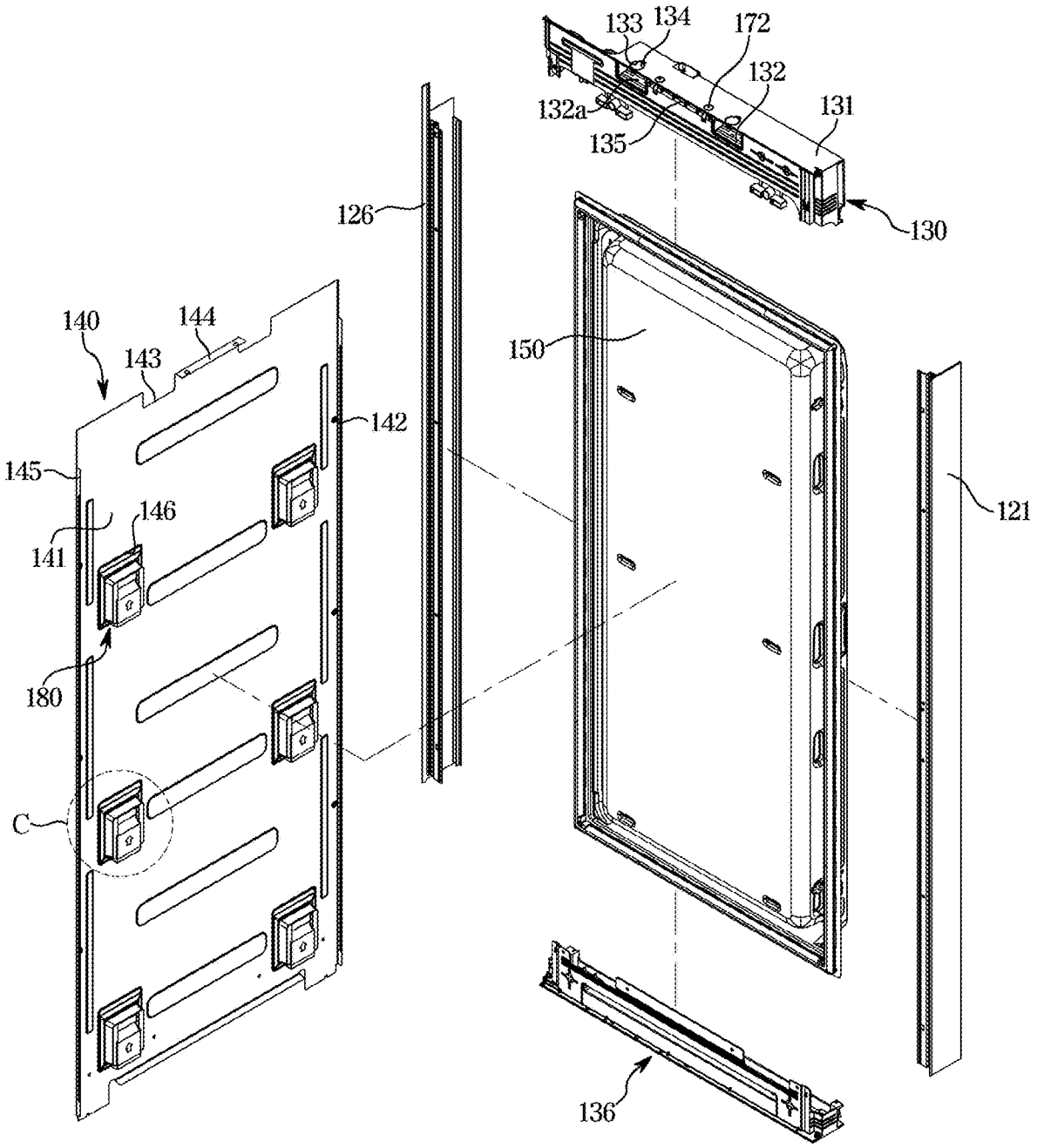
FIG. 8 is an exploded view illustrating a door body shown in FIG. 3.
Figure 9:
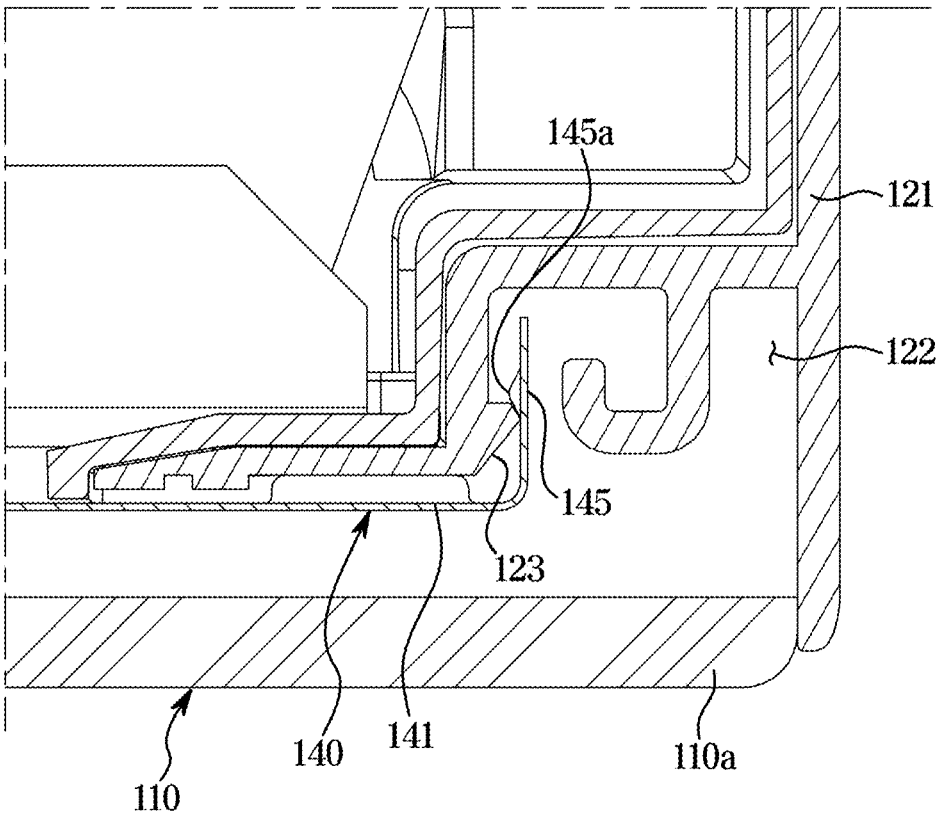
FIG. 9 illustrates an enlarged cross-sectional view taken along line B-B' of FIG. 2.
Figure 10:
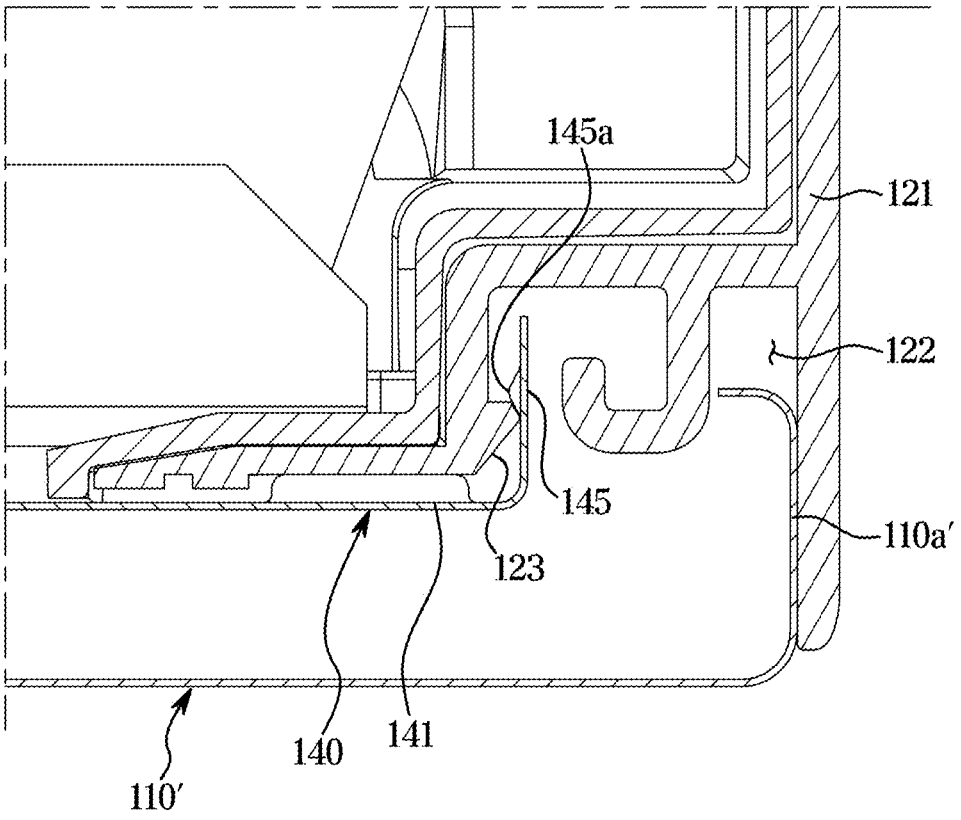
FIG. 10 is a view illustrating a state in which another type of door panel is coupled to the first door shown in FIG. 9.

FIG. 2 is a view illustrating a first door shown in FIG. 1. FIG. 3 is an exploded view illustrating a state in which a door panel is dissembled from the first door shown in FIG. 2. FIG. 4 is an enlarged view illustrating portion A of in FIG. 2. FIG. 5 is an enlarged view illustrating portion A' of in FIG. 3. FIG. 6 is a view illustrating a first fixer shown in FIG. 3. FIG. 7 is a view illustrating a second fixer shown in FIG. 3. FIG. 8 is an exploded view illustrating a door body shown in FIG. 3. FIG. 9 illustrates an enlarged cross-sectional view taken along line B-B' of FIG. 2. FIG. 10 is a view illustrating a state in which another type of door panel is coupled to the first door shown in FIG. 9.

Referring to FIGS. 2 to 8, the first door 101 may include a door panel 110 and a door body 120. The door panel 110 may be detachably coupled to the door body 120.

Referring to FIG. 3, the door panel 110 may include a panel body 111, an edge cover 113, and a buffer member 115.

The panel body 111 may form the extern appearance of the first door 101. The panel body 111 may have a flat plate shape. A variety of designs may be provided on the front surface of the panel body 111 to satisfy the user's needs. First and second fixers 161 and 166 may be disposed on the rear surface of the panel body 111 to be coupled to the door body 120.

The edge cover 113 may be arranged on an upper end of the rear surface of the panel body 111. The edge cover 113 may be formed to cover at least a portion of an upper edge of the panel body 111. The edge cover 113 may be integrally formed with the panel body 111 or may be detachably provided on the panel body 111.

Referring to FIG. 4, the edge cover 113 may be provided to cover at least a portion of the edge of the panel body 111 together with a first chassis (or a right chassis 121), a second chassis (or a left chassis 126), and a lower door cap 136 when the door panel 110 is mounted to the door body 120. The door panel 110 may be coupled to the door body 120 by sliding from an upper front side to a lower rear side.

In detail, referring to FIG. 5, the door body 120 may have the first chassis 121, the second chassis 126, and the lower door cap 136, at least a portion of which protrudes forward with respect to a cover 140 so as to cover at least a portion of the edge of the door panel 110. However, the door body 120 has an upper door cap 130 that is not provided with a portion protruding to cover at least a portion of the upper edge of the door panel 110, different from the first chassis 121, the second chassis 126, and the lower door cap 136. That is, the forward protruding lengths of the chassis 121 and 126 and the lower door cap 136 may be provided longer than the forward protruding length of the upper door cap 130. Steps may be formed in the front and rear directions at coupling portions of the upper ends of the chassis 121 and 126 and the upper door cap 130.

That is, the door body 120 may form a space in which the door panel 110 is mounted, and an upper side of the space in which the door panel 110 is mounted may be open for the door panel 110 to be mounted therein. The edge cover 113 of the door panel 110 may be positioned on the open upper side of the door body 120 when the door panel 110 is mounted to the door body 120. The edge cover 113 may have a portion protruding by a length corresponding to the lengths of the portions of the chassis 121, 126 protruding to cover the at least one portions of left and right side edges of the panel body 111 when the door panel 110 is mounted to the door body 120. With such a configuration, the edge cover 113, the chassis 121 and 126, and the lower door cap 136 may deliver a sensation of a unitary structure when the door panel 110 is mounted on the door body 120.

However, unlike the above, the edge cover 113 may be omitted, and the chassis 121 and 126 and the lower door cap 136 may not have portions protruding to cover at least one portions of the left and right side edges and the lower side edge of the panel body 111. In this case, the edge portion of the panel body 111 of the door panel 110 exposed to the user may be rounded for the safety of use.

Unlike the above, the edge cover 113 of the door panel 110 may be located at the left side end or the right side end of the panel body 111. Accordingly, the door panel 110 may be coupled to the door body 120 by sliding in the left or right direction.

The buffer member 115 may be disposed on the rear surface of the panel body 111. The buffer member 115 may be disposed in a space formed between the door panel 110 and the cover 140. The buffer member 115 may be configured to prevent the shock from being transmitted to the cover 140 when an impact is applied to the door panel 110. In addition, the buffer member 115 may be configured to absorb the noise that may be generated in the door panel 110. The buffer member 115 may include expanded polystyrene.

The buffer member 115 may be provided in a plurality of units thereof. The plurality of buffer members 115 may form a flow path that allows a fluid to flow between the door panel 110 and the cover 140.

The buffer member 115 may be provided to have a thickness corresponding to a thickness of a first fixing body 162 of the first fixer 161 and a second fixing body 167 of the second fixer 166.

Referring to FIGS. 3 and 6, the first fixer 161 may be mounted to the rear surface of the panel body 111. The first fixer 161 may be attached to the panel body 111 by an adhesive (118 in FIG. 18). The first fixer 161 may include the first fixing body 162 that comes into contact with the panel body 111. The first fixer 161 may be provided to be screwed to the door body 120.

The first fixing body 162 may have a bent portion **162*a* at an upper end thereof. The bent portion 162*a* may extend in a direction away from the panel body 111. The bent portion 162*a* may extend toward the door body 120**.

The bent portion **162*a* is provided with a fixing hole 163. The fixing hole 163 may be provided to be screwed with the upper door cap 130 when the door panel 110 is mounted to the door body 120. As a first fastening member (171 in FIG. 18) is coupled to the fixing hole 163 and a cap hole 132*a* of the upper door cap 130, the first fixer 161 is fixed to the upper door cap 130**.

The bent portion 162*a* is provided at an end thereof with a locking protrusion 164. The locking protrusion 164 may extend downward from the end of the bent portion 162*a*. The locking protrusion 164 may be inserted into a frame accommodation groove (132*b* in FIG. 18) of the upper door cap 130. As the locking protrusion 164 is inserted into a frame accommodation groove 132*b* of the upper door cap 130 and locked therewith, the door panel 110 may be additionally supported by the door body 120.

Referring to FIG. 3, since the door panel 110 is mounted to the door body 120 by sliding from the upper side to the lower side, the first fixer 161 is illustrated as being disposed at the upper end portion of the panel body 111. However, when the door panel 110 is coupled to the door body 120 by sliding from the left side to the right side of the door body 120 or from the right side to the left side of the door body 120, the first fixer 161 may be disposed at the left end or the right end of the panel body 111. In addition, when the door panel 110 is coupled to the door body 120 by sliding from the lower side to the upper side, the first fixer 161 may be disposed at the lower end portion of the panel body 111.

Referring to FIGS. 3 and 7, the second fixer 166 may be mounted on the rear surface of the panel body 111. The second fixer 166 may be attached to the panel body 111 through an adhesive (119 in FIG. 17). The second fixer 166 may include a second fixing body 167 that comes into contact with the panel body 111. The second fixer 166 may be provided to be hooked with the door body 120.

The second fixer 166 may include a hook 168 protruding from the second fixing body 167 toward the door body 120. The hook 168 may be provided to be inserted into a cover fixer 180 disposed on the cover 140.

In detail, when the hook 168 may include a coupling guide part 168*a* that may be obliquely formed to guide the movement of the hook 168 when the hook 168 is inserted into the cover fixer 180. The coupling guide part 168*a* may be provided at a front end portion defined in a direction of the hook 168 being inserted into the cover fixer 180. The coupling guide part 168*a* extends from the panel body 111 toward the door body 120 while obliquely facing down.

The hook 168 may include a seating part 168*b* extending rearward from the second fixing body 167 and an extension part 168*c* extending from the seating part 168*b* to the coupling guide part 168*a*. The seating part 168*b* may be provided to support the load of the door panel 110 when the hook 168 is inserted into the cover fixer 180.

The first and second fixers 161 and 166 allow the door panel 110 to be firmly coupled to and easily separated from the door body 120.

In FIGS. 2 and 3, the door panel 110 covering the front of the door body 120 is illustrated as a single panel body 111, but the disclosure is not limited thereto, and the door panel 110 may include a plurality of the panel bodies 111 and each of the panel bodies may include a first fixer and a second fixer, and the first and second fixers provided on each panel body may be provided in the same manner or different manner according to the direction in which each panel body is coupled to the door body 120. In addition, the above description has been made in relation that the door panel 110 includes the first fixer 161 having the locking protrusion 164 and the second fixer 166 having the hook 168 and the door body 120 includes the cover fixer 180 having the accommodation space 182, but the disclosure is not limited thereto. For example, unlike FIG. 3, the door panel 110 may include a cover fixer having an accommodation space, and the door body 120 may include a first fixer and a second fixer in a hook shape. However, in this case, when the door panel 110 is coupled to the door body 120, the locking protrusion of the first fixer and the hook of the second fixer may extend upward and the accommodation space of the cover fixer may also extend upward such that the door panel 110 is fixed to the door body 120 by its own weight.

Referring to FIGS. 3 and 8, the door body 120 includes the chassis 121 and 126, the upper door cap 130, the lower door cap 136, the cover 140, and a case 150. The chassis 121 and 126 may include a material different from a material forming the upper door cap 130 and the lower door cap 136. In detail, the chassis 121 and 126 may include aluminum. The upper door cap 130 and the lower door cap 136 may include acrylonitrile butadiene styrene copolymer (ABS) resin.

The chassis 121 and 126 may include the first chassis 121 forming the right side surface of the first door 101 and the second chassis 126 forming the left side surface of the first door 101. The chassis 121 and 126 may extend in the vertical direction.

Referring to FIGS. 8 and 10, the chassis 121 and 126 may include an edge accommodation groove 122. Hereinafter, the first chassis 121 will be described for the sake of convenience in description, and the same structure may be applied to the second chassis 126.

The first chassis 121 may include an edge accommodation groove 122 positioned to correspond to the right end portion of the door panel 110 when the door panel 110 is mounted to the door body 120. The edge accommodation groove 122 may be provided as a recess formed in one surface of the first chassis 121 facing the door panel 110 to accommodate the end portion of the door panel 110 when the door panel 110 is coupled to the first chassis 121.

In detail, as shown in FIG. 9, the door panel 110 may have a thickness of a predetermined size or more. The door panel 110 illustrated in FIG. 9 may include glass. When the door panel 110 has a thickness greater than or equal to a predetermined size, an end portion 110*a* of the door panel 110 may be smoothed.

However, when it is not easy to smooth an end portion 110*a*' of a door panel 110' as illustrated in FIG. 9, the end portion 110*a*' of the door panel 110' may be subject to a bending treatment. In this case, the end portion 110*a*' of the door panel 110' bent backward may be accommodated in the edge accommodation groove 122 of the first chassis 121. The door panel 110' shown in FIG. 10 may be provided as an iron plate.

With such a configuration, the chassis 121 and 126 having the edge accommodation groove 122 may be compatible with various types of door panels 110 and 110'.

The first chassis 121 may include a fixing protrusion 123 for fixing the cover 140. The fixing protrusion 123 may protrude toward a fixing rib 145 of the cover 140.

Referring to FIGS. 3 and 8, the upper door cap 130 may be coupled to the upper ends of the chassis 121 and 126. The upper door cap 130 may form the upper surface of the first door 101. The upper door cap 130 may include a first cap body 131.

Figure 18:
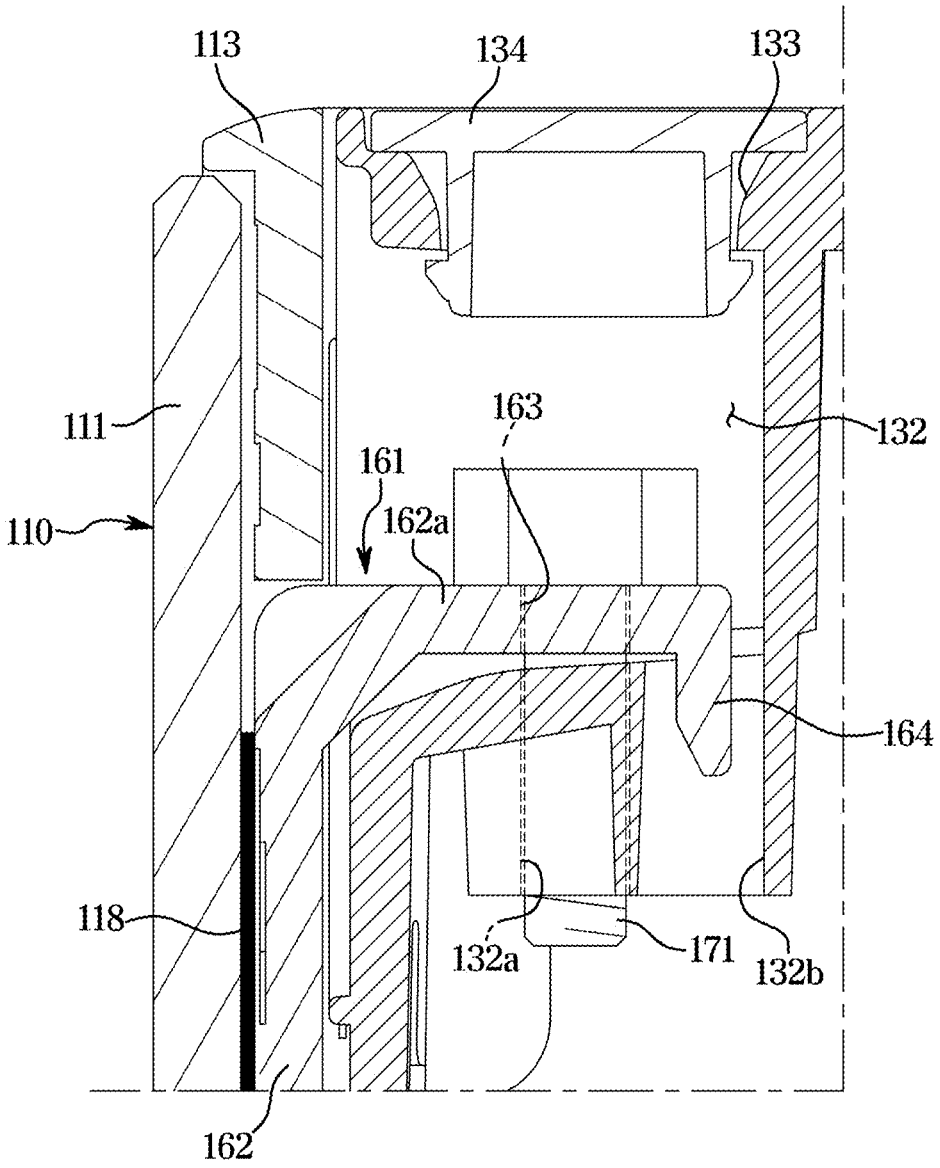
FIG. 18 is an enlarged view illustrating portion G of FIG. 16.

In detail, referring to FIG. 18, the first cap body 131 may be provided with a coupling groove 132. The coupling groove 132 may be provided as a recess formed in one surface of the first cap body 131 facing the door panel 110. The coupling groove 132 may be provided to accommodate a portion of the first fixer 161.

The coupling groove 132 may be provided with a cap hole 132*a*. The cap hole 132*a* may be formed at a position corresponding to the fixing hole 163 when the first fixer 161 is mounted in the coupling groove 132. When the door panel 110 is fixed to the door body 120, the first fastening member 171 may be screwed to the fixing hole 163 and the cap hole 132*a*.

The coupling groove 132 may be provided with the frame accommodation groove 132*b*. The frame accommodation groove 132*b* may be formed to accommodate the locking protrusion 164 of the first fixer 161. The frame accommodation groove 132*b* may support the locking protrusion 164 so that the door panel 110 is not separated from the door body 120.

The first cap body 131 may be provided with a slit 135. A cover rib 144 of the cover 140 may be inserted into the slit 135. When the cover rib 144 is inserted into the slit 135, a second fastening member 172 is inserted into the cover rib 144 and the slit 135 to fix the door panel 110 to the upper door cap 130.

The first cap body 131 is provided on the upper surface thereof with a through hole 133. In detail, referring to FIGS. 3, 8, and 18, when a first cap cover 134 is not mounted, the through hole 133 may allow the coupling groove 132 to communicate with the outside. The first fastening member 171 may be inserted into the coupling groove 132 through the through hole 133 and then screwed to the fixing hole 163 and the cap hole 132*a*. After the insertion of the first fastening member 171 is completed, the through hole 133 may be covered by the first cap cover 134. The first cap cover 134 may be detachably mounted to the first cap body 131 to open and close the through hole 133.

The lower door cap 136 may be coupled to the lower ends of the chassis 121 and 126. The lower door cap 136 may form the lower surface of the first door 101. The lower door cap 136 may be provided with a first door handle (not shown).

The chassis 121 and 126, the upper door cap 130, and the lower door cap 136 may form the upper, lower, left, and right side surfaces of the first door 101. The chassis 121, 126, the upper door cap 130, and the lower door cap 136 may be collectively referred to as a door frame. The door frame may have a front side and a rear side thereof open. Meanwhile, although FIG. 8 illustrates that the chassis 121 and 126, the upper door cap 130, and the lower door cap 136 are detachably provided, the chassis 121 and 126 and the upper door cap 130, and the lower door cap 136 may be integrally formed with each other. That is, the door frame may be formed in a unitary body.

The cover 140 may be mounted to the door frame to cover the open front side of the door frame. The cover 140 may include a cover body 141.

The cover body 141 may include a cover hole 142 through which a rivet (not shown) passes when the cover 140 is coupled to the chassis 121 and 126. As the rivet is coupled to the chassis 121 and 126 by passing through the cover hole 142, the cover body 141 may be fixed at both ends thereof to the chassis 121 and 126.

The cover body 141 may include a cutout 143 formed to correspond to the coupling groove 132 of the upper door cap 130. The cutout 143 may be formed to expose the coupling groove 132 when the cover 140 is coupled to the door frame. The cutout 143 allows a portion of the first fixer 161 to be inserted into the coupling groove 132.

The cover body 141 may include the cover rib 144 to be coupled to the upper door cap 130. The cover rib 144 may extend from the upper end of the cover body 141 toward the upper door cap 130. When the cover 140 is mounted to the door frame, the cover rib 144 may be fixed by the second fastening member 172 while being inserted into the slit 135 of the upper door cap 130.

The cover body 141 may be provided at left and right side ends thereof with the fixing ribs 145 to be respectively coupled to the chassis 121 and 126. The fixing ribs 145 may extend from the left and right side ends of the cover body 141 toward the chassis 121 and 126.

In detail, referring to FIG. 9, the fixing ribs 145 may be provided with plate beads 145*a* protruding toward the chassis 121 and 126. When the cover 140 is mounted to the door frame, the plate bead 145*a* of the fixing rib 145 may be coupled to the fixing protrusion 123 of the first chassis 121. Accordingly, the cover 140 may be supported by the chassis 121 and 126.

The cover 140 may include the cover fixer 180 provided to be coupled to the second fixer 166. The cover body 141 may have a mounting hole 147 for fixing the cover fixer 180. The cover fixer 180 may be detachably mounted to the mounting hole 147. The cover body 141 may be provided with a guide bead 146 for guiding the mounting of the cover fixer 180.

The case 150 may be mounted to the door frame to cover the open rear side of the door frame. The case 150 may include the first shelf support part 107 on which the first door shelf 105 is mounted.

Hereinafter, a process of assembling the door body 120 will be described.

First, the upper door cap 130 and the lower door cap 136 are respectively coupled to the upper and lower ends of the chassis 121 and 126 to form the door frame. The cover 140 and the case 150 are coupled to the front and rear surfaces of the door frame to form the door body 120. A heat insulating material (not shown) is foamed to the inside of the door body 120.

Figure 11:
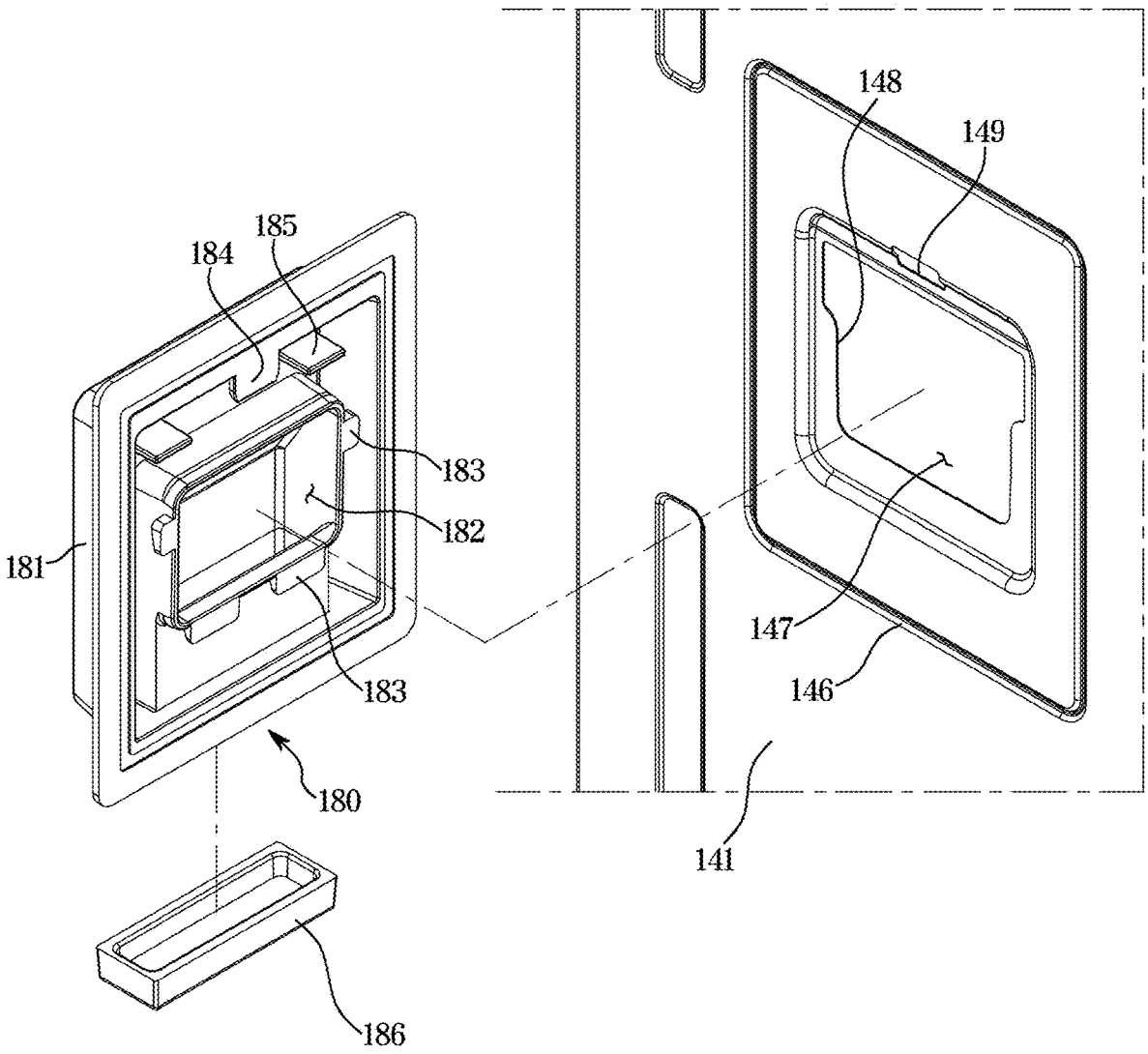
FIG. 11 is an enlarged view illustrating portion C of FIG. 6.
Figure 12:
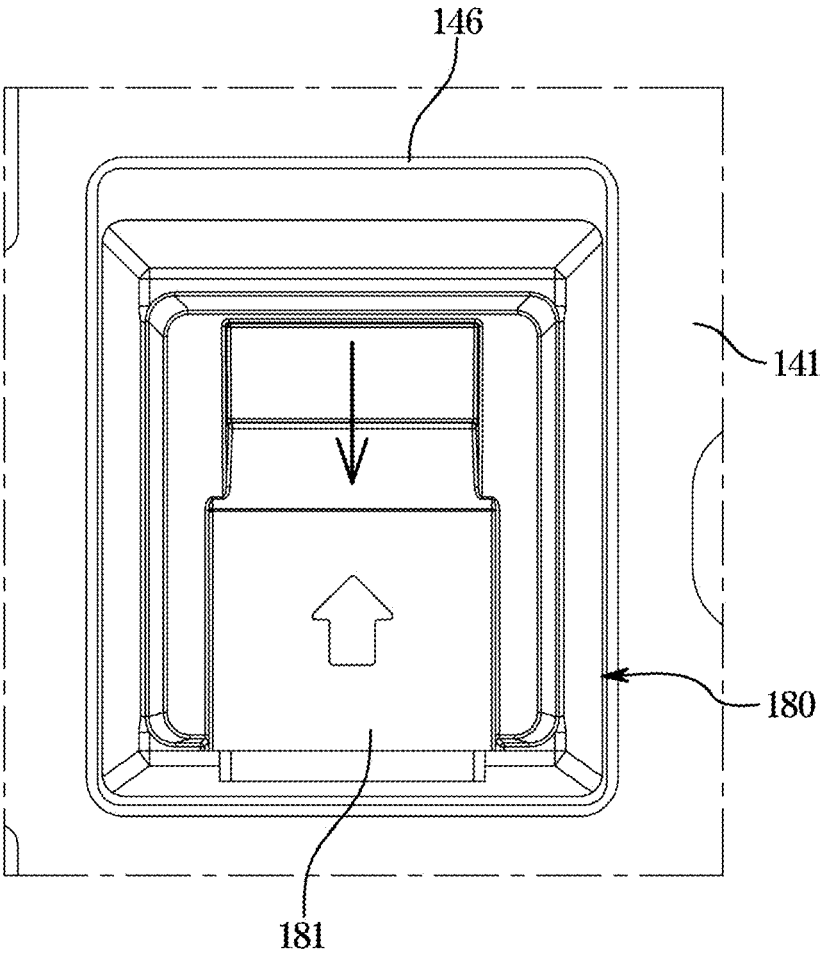
FIG. 12 is a rear view illustrating a state in which a cover fixer shown in FIG. 11 is fixed to a panel body.
Figure 13:
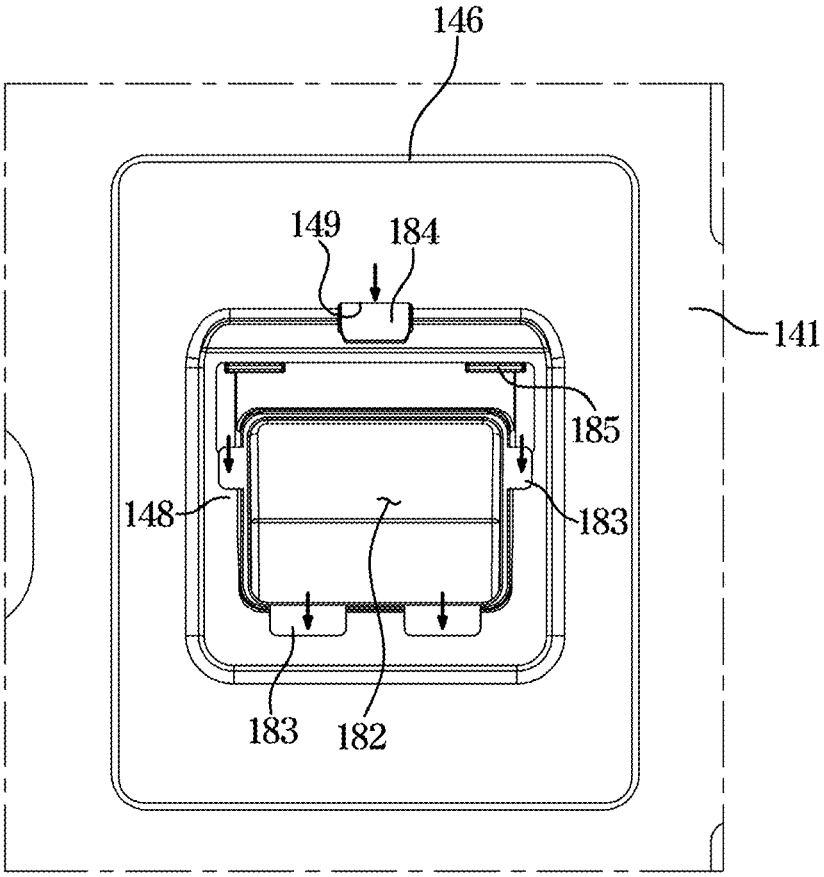
FIG. 13 is a front view illustrating a cover fixer fixed to the panel body shown in FIG. 12.

FIG. 11 is an enlarged view illustrating portion C shown in FIG. 6. FIG. 12 is a rear view illustrating a state in which a cover fixer shown in FIG. 11 is fixed to a panel body. FIG. 13 is a front view illustrating a cover fixer fixed to the panel body shown in FIG. 12.

Referring to FIGS. 11 to 13, a configuration of coupling the cover fixer 180 to the cover 140 will be described.

Referring to FIG. 11, the guide bead 146 formed on the cover body 141 of the cover 140 may be disposed at an outer side of the circumference of the mounting hole 147. The guide bead 146 may be formed to guide the sliding movement when the cover fixer 180 is coupled to the cover 140. The guide bead 146 may be formed to correspond to the outer edge of the cover fixer 180 in a size that allows the length for sliding movement.

The cover body 141 may include a guide rib 148 that forms a portion of an edge of the mounting hole 147. The guide rib 148 may be coupled to the guide protrusion 183 of the cover fixer 180 as the cover fixer 180 is slidably coupled to the cover 140. The guide rib 148 may form a narrower portion of the mounting hole 147. A portion of the guide protrusion 183 may be inserted into a wider portion of the mounting holes 147, and slide downward to be coupled to the guide rib 148. The guide rib 148 may be provided to correspond to the guide protrusion 183.

The cover body 141 may include an auxiliary hole 149 formed at one side of the mounting hole 147. The auxiliary hole 149 may be provided to be coupled to an auxiliary protrusion 184 of the cover fixer 180. As the cover fixer 180 is slidably coupled to the cover 140, the auxiliary protrusion 184 is slid into the auxiliary hole 149 and insertedly fixed thereto.

The cover fixer 180 may include the fixer body 181 and the accommodation space 182 formed in the fixer body 181. The accommodation space 182 may be provided as a recess formed in a direction of the lower rear side of the fixer body 181. The accommodation space 182 may be formed to accommodate the hook 168 of the second fixer 166.

The cover fixer 180 may include the guide protrusion 183 and the auxiliary protrusion 184 to be fixed to the cover body 141. The guide protrusion 183 may protrude to be coupled to the guide rib 148. The auxiliary protrusion 184 may protrude to be inserted into the auxiliary hole 149. The guide protrusion 183 and the auxiliary protrusion 184 may extend along a plane on which the cover fixer 180 is slid. The guide protrusion 183 may be disposed on the left and right and/or the lower side of the accommodation space 182.

The cover fixer 180 may include a stopper 185 that is caught by the mounting hole 147 when the cover fixer 180 is mounted to the cover 140, to prevent the cover fixer 180 from being separated. In detail, referring to FIG. 13, the stopper 185 may extend to have at least one portion that passes through the mounting hole 147 when the cover fixer 180 is mounted to the cover body 141. The stopper 185 is provided such that an end portion of the cover fixer 180 is caught and interfere with the edge of the mounting hole 147 when the cover fixer 180 is mounted to the cover body 141, and serves to fix the cover fixer 180 without being separated from the cover body 141 unless receiving a force greater than a predetermined magnitude. The stopper 185 may include a material having a predetermined elasticity such that the cover fixer 180 is separated from the cover body 141.

Figure 17:
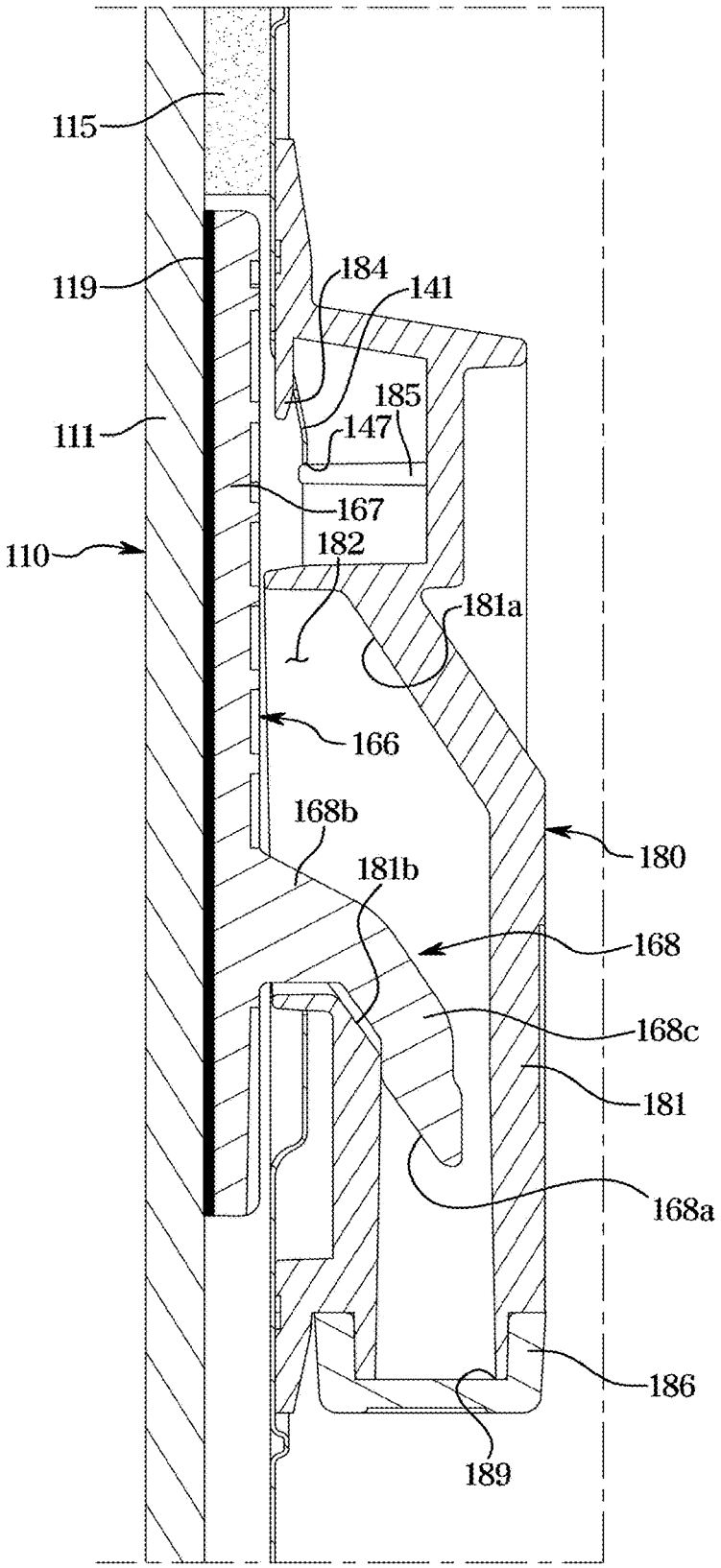
FIG. 17 is an enlarged view illustrating portion F of FIG. 16.

Referring to FIGS. 11 and 17, the cover fixer 180 may include a fixer cap 186 that covers a cover opening 189 of the accommodation space 182. In detail, when the cover fixer 180 is injection molded, the accommodation space 182 is formed to have both ends thereof open by the manufacturing process. The cover fixer 180 may be coupled to the second fixer 166 through an opening formed at one of the both open ends of the accommodation space 182. The cover opening 189, which is formed at the other open end opposite to the opening coupled to the second fixer 166, of the accommodation space 182 may be covered by the fixer cap 186. The fixer cap 186 may be detachably mounted to the fixer body 181. As the fixer cap 186 closes the cover opening 189, the heat insulating material may not be discharged to the outside through the accommodation space 182 when the heat insulating material is filled in the door body 120.

In detail, referring to FIGS. 12 and 13, the cover fixer 180 may be inserted into the mounting hole 147 at a position where the guide protrusion 183 is not interfered by the guide rib 148. At this time, the auxiliary protrusion 184 is not inserted into the auxiliary hole 149. Thereafter, when the cover fixer 180 is lowered along the guide bead 146, the guide protrusion 183 is coupled and fixed to the guide rib 148, and the auxiliary protrusion 184 is inserted and fixed to the auxiliary hole 149.

With such a configuration, the cover fixer 180 may be easily coupled to and separated from the cover body 141. In addition, such a coupling structure may apply a relatively small load to the cover body 141, thereby improving the durability of the cover body 141 and minimizing the deformation of the cover body 141.

Figure 14:
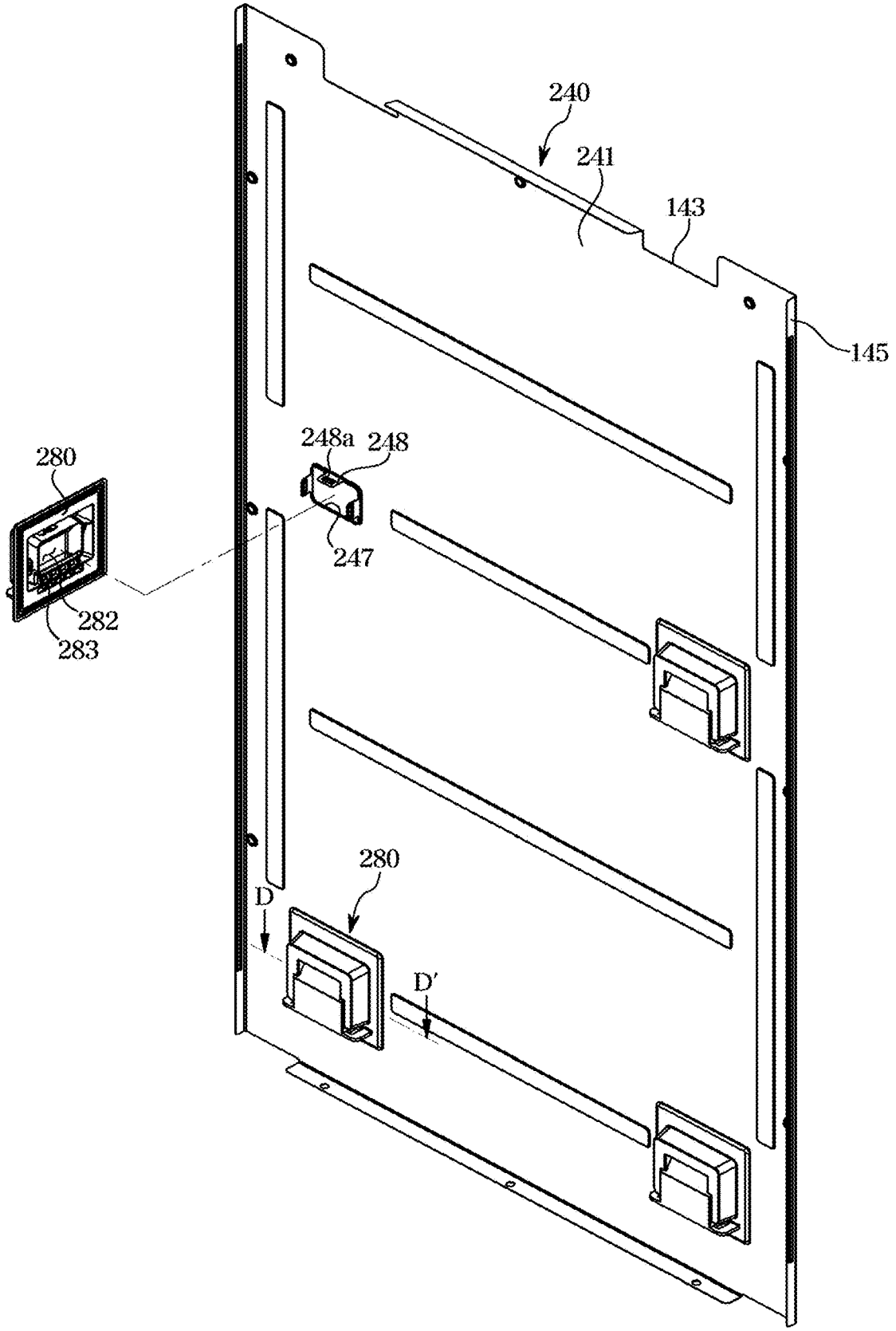
FIG. 14 is a view illustrating a rear surface of a cover according to another embodiment of the disclosure.
Figure 15:
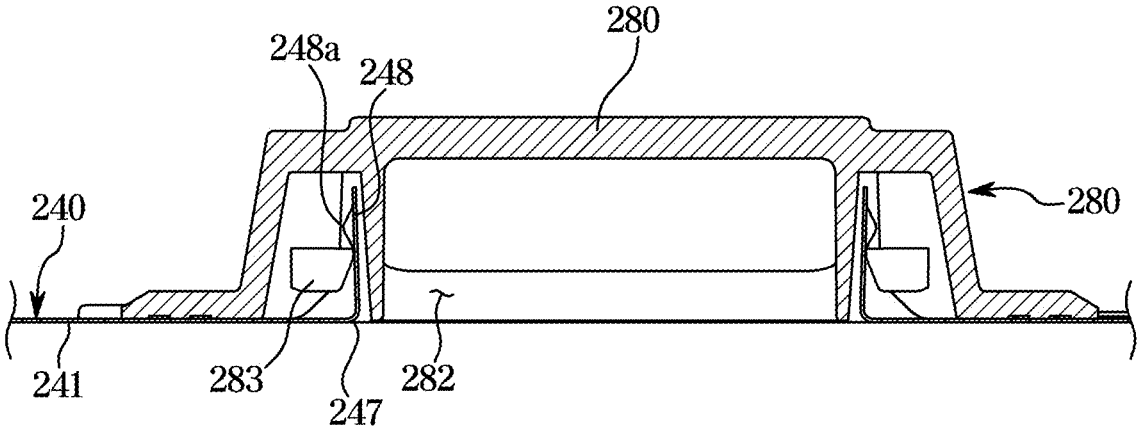
FIG. 15 illustrates a cross-sectional view taken along line D-D' shown in FIG. 14.

FIG. 14 is a view illustrating a rear surface of a cover according to another embodiment of the disclosure. FIG. 15 illustrates a cross-sectional view taken along line D-D' shown in FIG. 14.

Referring to FIGS. 14 and 15, a cover 240 according to another embodiment of the disclosure will be described. However, in the following description, parts identical to those of the previous embodiment shown in FIGS. 1 to 13 will be assigned the same reference numerals, and omitted in order to redundancy.

Referring to FIG. 14, a cover fixer 280 may be coupled to a cover body 241 of a cover 240 in a different manner from that of the embodiment shown in FIGS. 12 and 13.

The cover body 241 of the cover 240 may include a mounting hole 247 and a mounting protrusion 248 extending rearward from an edge of the mounting hole 247. The mounting protrusion 248 may include a mounting bead 248*a* that is coupled to a coupling protrusion 283 of a cover fixer 280 when the cover fixer 280 is fixed to the cover body 241.

In detail, referring to FIG. 15, the cover fixer 280 is aligned such that an accommodation space 282 faces the mounting hole 247, and then is mounted to the cover body 241, so that the coupling protrusion 283 of the cover fixer 280 is coupled to the mounting protrusion 248 of the cover body 241. The coupling protrusion 283 and/or the mounting protrusion 248 may include a material having elasticity. The coupling protrusion 283 and/or the mounting protrusion 248 are deformed and the coupling protrusion 283 is coupled to the mounting protrusion 248.

Figure 16:
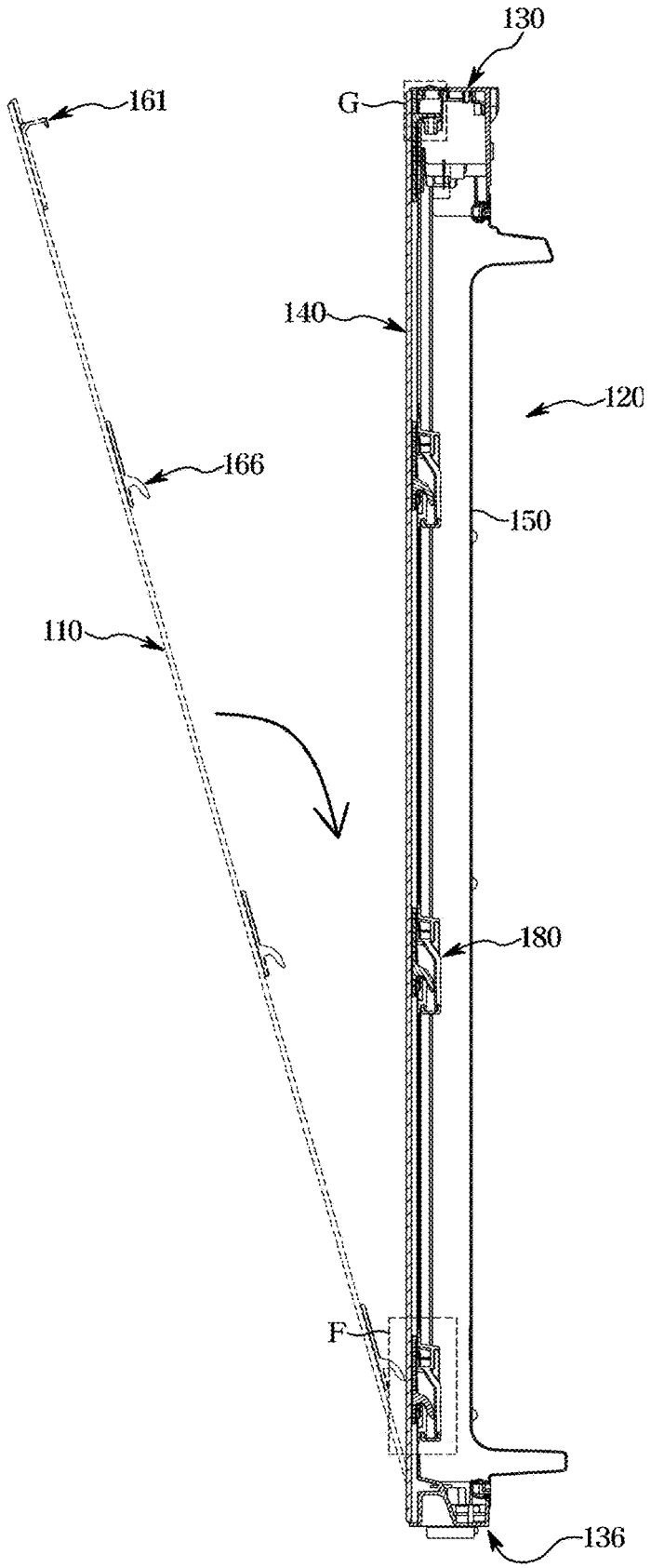
FIG. 16 illustrates a cross-sectional view taken along line E-E' shown in FIG. 2, which shows an operation of a door panel being coupled to a door body.

FIG. 16 illustrates a cross-sectional view taken along line E-E' shown in FIG. 2, which shows an operation of a door panel being coupled to a door body. FIG. 17 is an enlarged view illustrating portion F shown in FIG. 16. FIG. 18 is an enlarged view illustrating portion G shown in FIG. 16.

Hereinafter, a process of coupling the door panel 110 to the door body 120 will be described with reference to FIGS. 16 to 18. First, the door panel 110 is aligned by inserting the lowermost second fixer 166 into the lowermost cover fixer 180 of the door body 120 and then coupling the remaining fixers 161 and 166 to the upper door cap 130 and the cover fixer 180, so that the door panel 110 is mounted to the door body 120.

Referring to FIGS. 16 and 17, when the door panel 110 is coupled to the door body 120, the second fixer 166 may be coupled to the cover fixer 180 coupled to the cover 140.

In detail, the hook 168 of the second fixer 166 may be coupled to the accommodation space 182 of the cover fixer 180 by moving from the front upper side to the lower rear side. The movement of the hook 168 may be guided by guide surfaces 181*a* and 181*b* formed on the inner surface of the accommodation space 182. In detail, the coupling guide part 168*a* of the hook 168 may be guided into the accommodation space 182 by the first guide surface 181*a* and the second guide surface 181*b*. Since the coupling guide part 168*a* of the hook 168 has a slope in a direction the hook 168 is coupled to the accommodation space 182, the hook 168 may be easily inserted into the accommodation space 182.

Referring to FIGS. 16 and 18, when the door panel 110 is coupled to the door body 120, a portion of the first fixer 161 is inserted into the coupling groove 132 formed in the upper door cap 130.

In detail, when a portion of the first fixer 161 is inserted into the coupling groove 132, the locking protrusion 164 of the first fixer 161 may be inserted into and fixed to the frame accommodation groove 132*b*. The first fastening member 171 is moved into the coupling groove 132 through the through hole 133, and then is screwed to the fixing hole 163 of the first fixer 161 and the cap hole 132*a* of the upper door cap 130. As such, the first fixer 161 is fixed to the upper door cap 130, so that the door panel 110 is coupled to the door body 120. The through hole 133 may be covered by the first cap cover 134.

Figure 19:
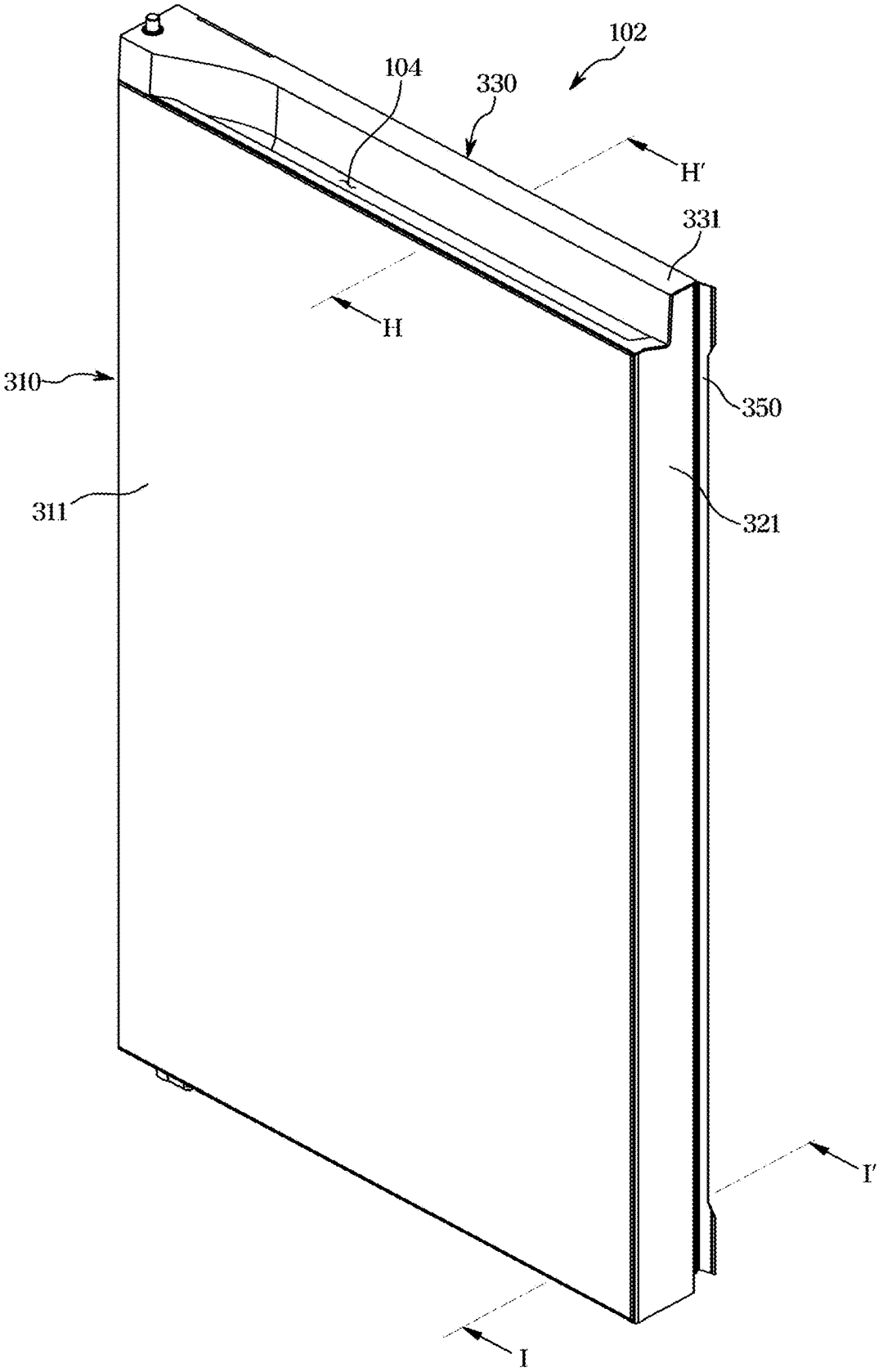
FIG. 19 is a view illustrating a second door shown in FIG. 1.
Figure 20:
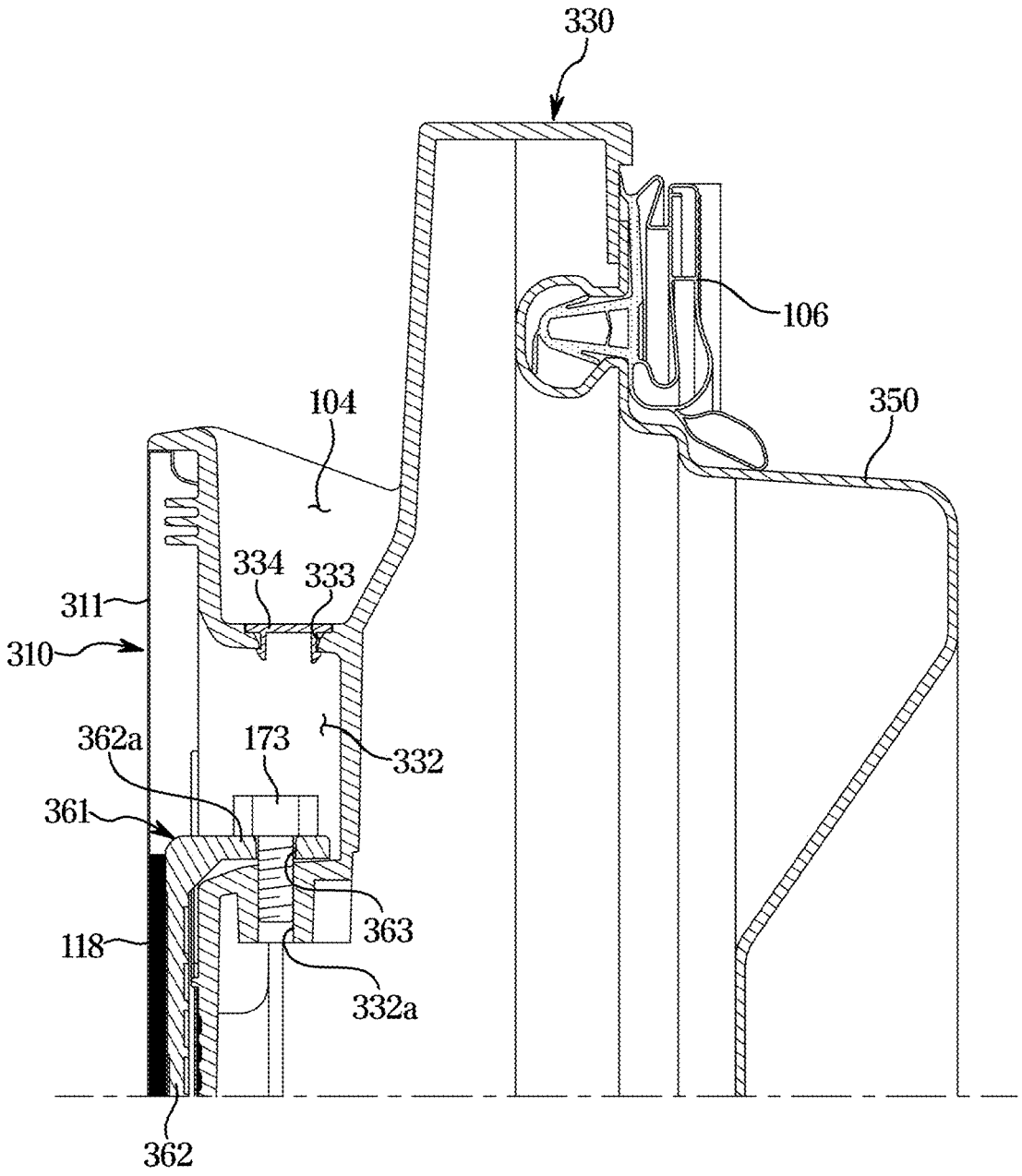
FIG. 20 illustrates an enlarged cross-sectional view taken along line H-H' shown in FIG. 19.
Figure 21:
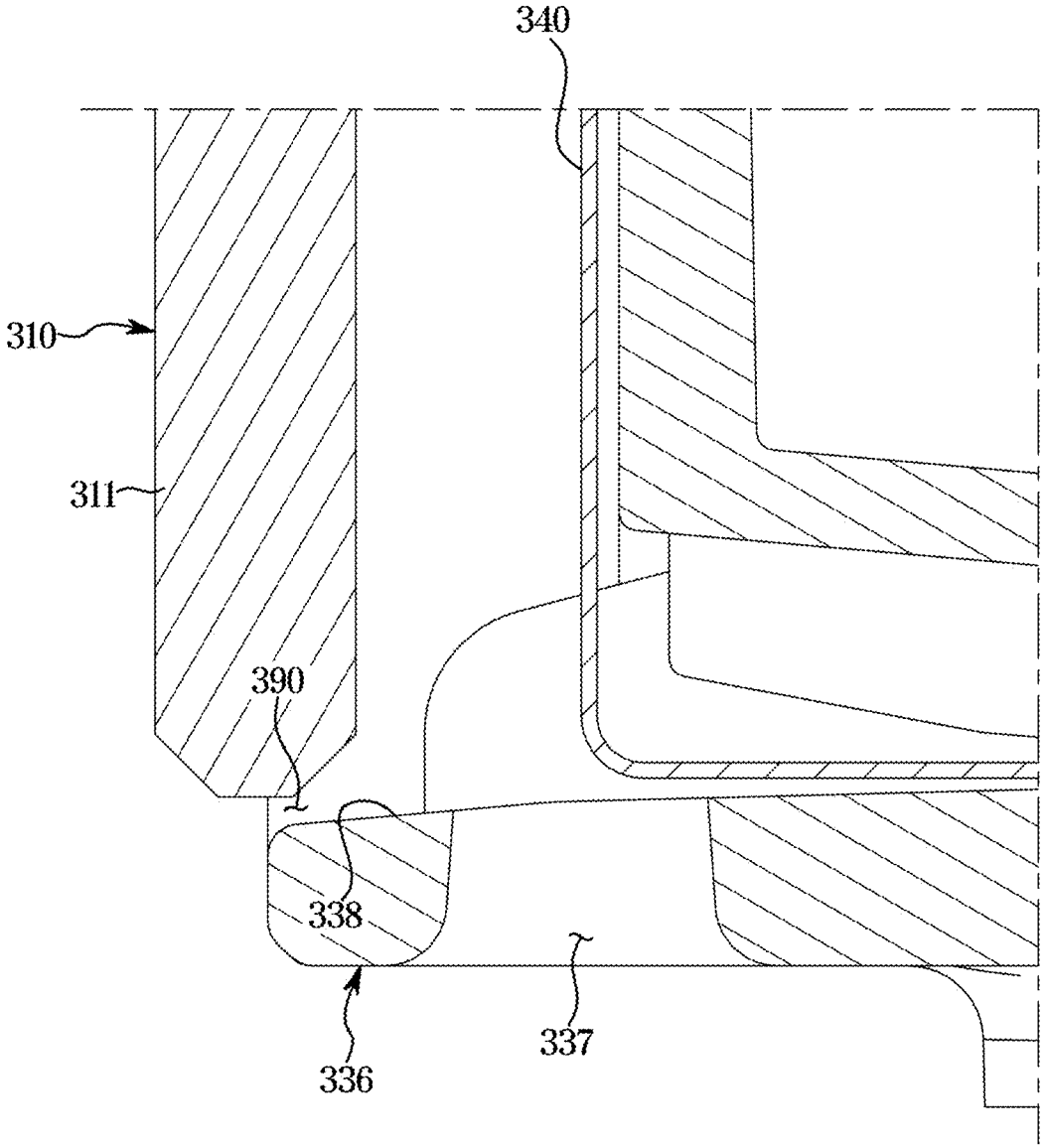
FIG. 21 illustrates an enlarged cross-sectional view taken along line I-I' of FIG. 19.

FIG. 19 is a view illustrating a second door shown in FIG. 1. FIG. 20 illustrates an enlarged cross-sectional view taken along line H-H' shown in FIG. 19. FIG. 21 illustrates an enlarged cross-sectional view taken along line I-I' of FIG. 19.

Referring to FIGS. 19 to 21, a configuration applied to the second door 102 will be described. Hereinafter, for the sake of convenience in description, one second door 102 will be described, and descriptions of the remaining second door 102 will be omitted. However, the configuration of the second door 102, which is not described, may be substantially the same except that the second door 102 is provided in mirror symmetry with the second door 102 described below. In addition, the same configuration as that of the second door 102 may be applied to the first door 101, and detailed description thereof may be omitted.

Referring to FIGS. 19 to 21, the second door 102 includes a door panel 310 that is provided to be replaceable, and the door panel 310 has a panel body 311.

The second door 102 includes an upper door cap 330 in which a second door handle 104 is formed. The second door handle 104 is provided as a recess formed in a second cap body 331.

The upper door cap 330, a lower door cap 336, and a chassis 321 may form a door frame, and a case 350 may be disposed on a rear surface of the door frame.

Referring to FIG. 20, as the second door handle 104 is formed in the upper door cap 330 of the second door 102, a structure for fixing a first fixer 361 to the upper door cap 330 may be different the fixing structure of the first door 101 described with reference to FIG. 18.

The first fixer 361 includes a first fixing body 362 having a bent portion 362*a* that is inserted into a coupling groove 332 of the upper door cap 330. A through hole 333 is formed through a bottom surface of the second door handle 104. A third fastening member 173 is moved into the coupling groove 332 through the through hole 333, and then is screwed to a fixing hole 363 and a cap hole 332*a*. The through hole 333 may be covered by a second cap cover 334.

Since the second door 102 has the through hole 333, which is used for the fastening of the third fastening member 173, in the bottom surface of the second door handle 104, the through hole 333 may be prevented from being exposed to the user.

Referring to FIG. 21, the lower door cap 336 of the second door 102 may include a structure for discharging condensate that may be generated in a space formed between the door panel 310 and a cover 340.

In detail, the lower door cap 336 of the second door 102 may include a drainage hole 337 for discharging condensate formed between the door panel 310 and the cover 340. The drainage hole 337 may communicate the space between the door panel 310 and the cover 340 with the outside of the second door 102. The drainage hole 337 may pass through the lower door cap 336 in the vertical direction.

In addition, the lower door cap 336 may include a drainage guide part 338. A front end of the lower door cap 336 and a lower end of the door panel 310 may be spaced apart from each other to form a gap 390. The drainage guide part 338 may be formed to slope downward as being directed from the rear side of the lower door cap 336 to the front side. The drainage guide part 338 and the gap 390 may allow a condensate, which is not discharged from the drainage hole 337, to be discharged.

In addition, air may be circulated through the gap 390 in the space between the door panel 310 and the cover 340.

Figure 22:
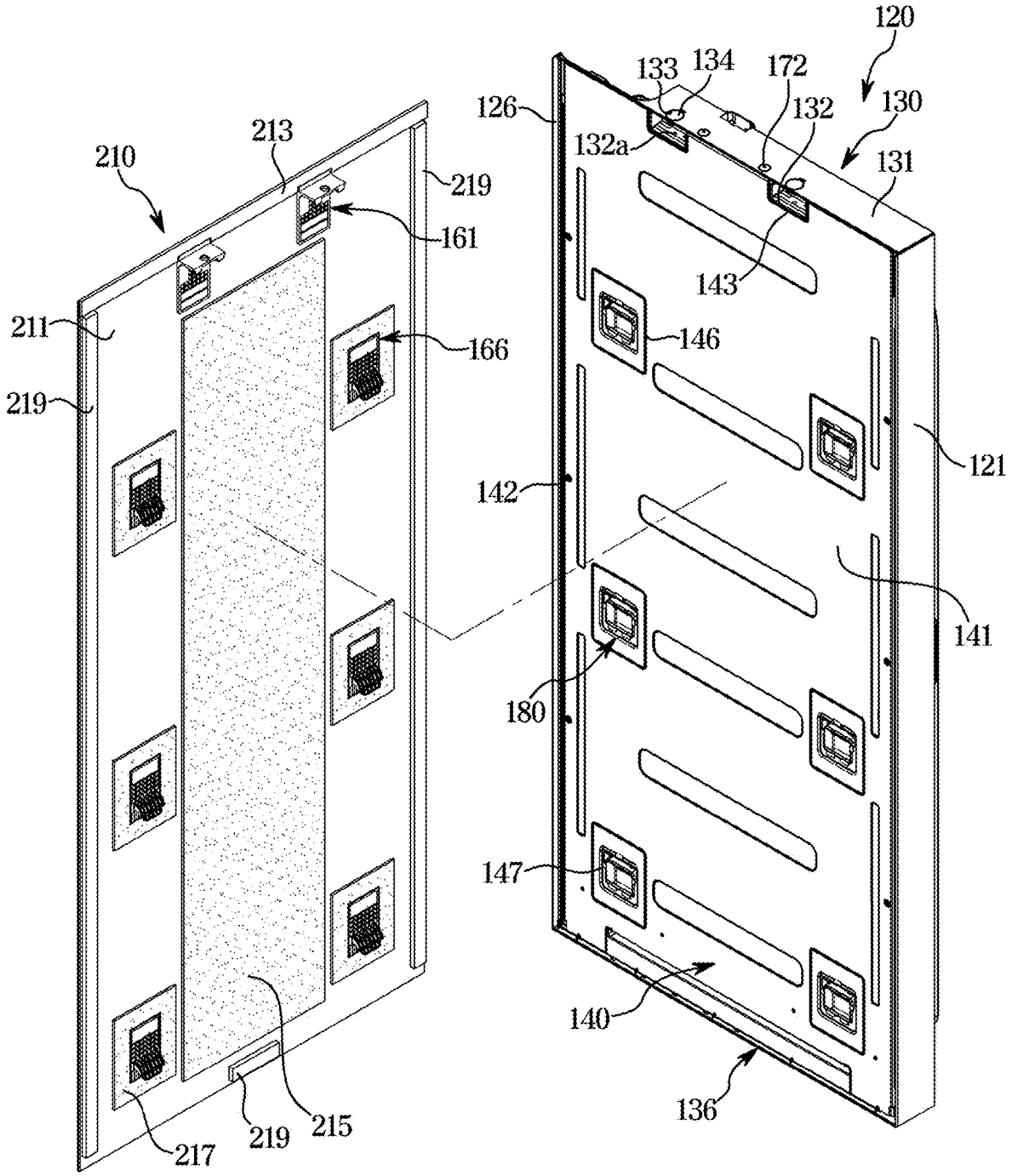
FIG. 22 is an exploded view illustrating a first door having a door panel according to another embodiment of the disclosure.

FIG. 22 is an exploded view illustrating a first door having a door panel according to another embodiment of the disclosure.

Referring to FIG. 22, a door panel 210 according to another embodiment of the disclosure will be described. In the following description, details of parts identical to those of the first door 101 shown in FIG. 3 will be omitted. In addition, the door panel 210 illustrated in FIG. 22 may be applied to the second door 102 illustrated in FIG. 1.

Similar to the door panel 110 shown in FIG. 3, the door panel 210 may be detachably coupled to the door body 120. The door panel 210 may include a panel body 211, an edge cover 213, a buffer member 215, a sealing member 217, and a fixing member 219.

The panel body 211 may form the external appearance of the door 100. The panel body 211 may have a flat plate shape. On the front surface of the panel body 211, a variety of designs may be formed to meet the needs of the user. The panel body 211 may include glass. First and second fixers 161 and 166 may be disposed on the rear surface of the panel body 211 to be coupled to the door body 120.

The edge cover 213 may be disposed at an upper end of the rear surface of the panel body 211. The edge cover 213 may be formed to cover at least a portion of an upper edge of the panel body 211. The edge cover 213 may be integrally formed with the panel body 211, and may be detachably provided from the panel body 211.

The buffer member 215 may be disposed on the rear surface of the panel body 211. The buffer member 215 may be disposed in a space formed between the door panel 210 and the cover 140. The buffer member 215 may be disposed between a plurality of second fixers 166. The buffer member 215 may be configured to prevent the shock from being transmitted to the cover 140 when an impact is applied to the door panel 210. In addition, the buffer member 215 may be configured to absorb noise that may occur in the door panel 210. The buffer member 215 may include expanded polystyrene.

The first fixer 161 may be mounted on the rear surface of the panel body 211. The second fixer 166 may be mounted on the rear surface of the panel body 211. The first fixer 161 may be provided in a pair thereof at an upper end portion of the rear surface of the panel body 211. The second fixer 166 may be provided in a plurality of units thereof on the rear surface of the panel body 211. The first fixer 161 and the second fixer 166 may allow the door panel 210 to be firmly coupled to and easily separated from the door body 120.

The sealing member 217 may be disposed along the circumference of the second fixer 166. The sealing member 217 may include a material having heat insulation. The sealing member 217 may be provided to prevent dew from forming on a portion of the panel body 211 on which the second fixer 166 is disposed and/or on a portion of the cover 140 on which the cover fixer 180 is disposed. The sealing member 217 may be aligned with the lower end of the second fixer 166 and then attached to the panel body 211.

The fixing member 219 may be disposed along a portion of the circumference of the panel body 211. The fixing member 219 may be disposed at the left and right end portions and the lower end portion of the panel body 211. The fixing member 219 may be fixed to the panel body 211 by a double-sided tape. The fixing member 219 may allow the door panel 210 to be more firmly fixed to the door body 120 after the door panel 210 is coupled to the door body 120.

The fixing member 219 may include a magnetic body. The fixing member 219 may be provided to generate an attraction force with respect to the cover 140 when the door panel 110 is coupled to the door body 120. The cover 140 may include steel. As the fixing member 219 is fixed to the cover 140 while in contact therewith by the attraction force between the fixing member 219 and the cover 140, the door panel 210 may be more stably fixed to the door body 120.

The fixing members 219 disposed at the left and right end portions of the panel body 211 may extend in the vertical direction along the left and right side edges of the panel body 211. The fixing members 219 disposed at the left and right end portions of the panel body 211 may be spaced apart from the left and right side ends of the panel body 211 by a predetermined interval. Upper end portions of the fixing members 219 disposed at the left and right side end portions of the panel body 211 may be disposed to come into close contact with the lower end of the edge cover 213.

The fixing member 219 disposed at the lower end portion of the panel body 211 may extend in the horizontal direction along the lower edge of the panel body 211, and may be arranged at an approximately center portion of the lower end portion of the panel body 211. The fixing member 219 disposed at the lower end portion of the panel body 211 may be spaced apart from the lower end of the panel body 211 by a predetermined interval.

Figure 23:
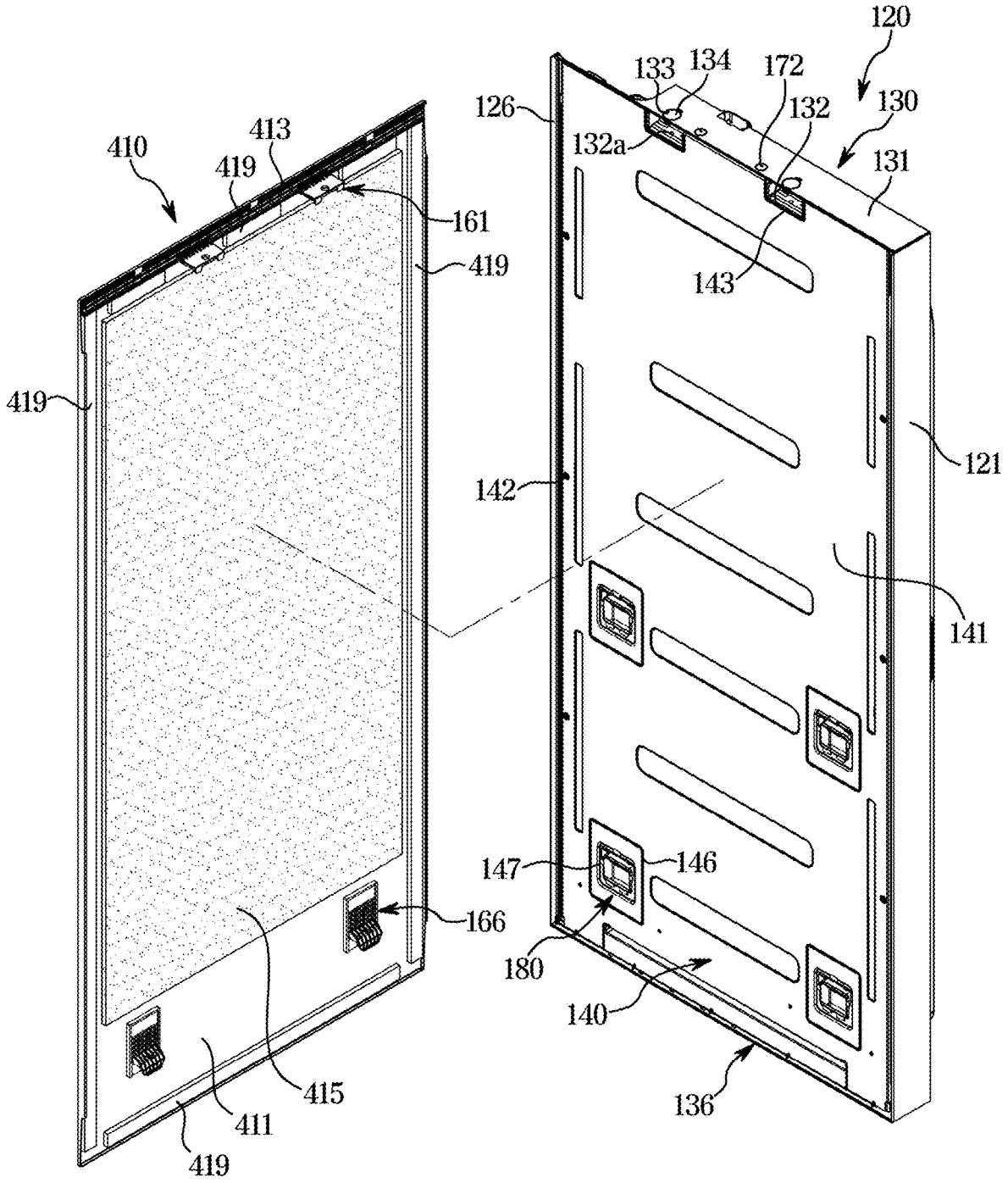
FIG. 23 is an exploded view illustrating a first door having a door panel according to still another embodiment of the disclosure.

FIG. 23 is an exploded view illustrating a first door having a door panel according to still another embodiment of the disclosure.

Referring to FIG. 23, a door panel 410 according to still another embodiment of the disclosure will be described. In the following description, details of parts identical to those of the door 100 shown in FIG. 3 may be omitted in order to redundancy. In addition, the door panel 410 illustrated in FIG. 23 may be applied to the second door 102 illustrated in FIG. 1.

Similar to the door panel 110 shown in FIG. 3, the door panel 410 may be detachably coupled to the door body 120. The door panel 410 may include a panel body 411, an edge cover 413, a buffer member 415, and a fixing member 419.

The panel body 411 may form the external appearance of the door 100. The panel body 411 may have a flat plate shape. On the front surface of the panel body 411, a variety of designs may be formed to meet the needs of the user. The panel body 411 may include steel. First and second fixers 161 and 166 may be disposed on the rear surface of the panel body 411 so as to be coupled to the door body 120.

The edge cover 413 may be disposed at an upper end portion of the rear surface of the panel body 411. The edge cover 413 may be formed to cover at least a portion of an upper edge of the panel body 411. The edge cover 413 may be integrally formed with the panel body 411, and may be detachably provided from the panel body 411.

The buffer member 415 may be disposed on the rear surface of the panel body 411. The buffer member 415 may be disposed in a space formed between the door panel 410 and the cover 140. The buffer member 415 may be disposed between the first fixer 161 and the second fixer 166. The buffer member 415 may be configured to prevent the shock from being transmitted to the cover 140 when an impact is applied to the door panel 410. In addition, the buffer member 415 may be configured to absorb noise that may occur in the door panel 410. The buffer member 415 may include expanded polystyrene.

The first fixer 161 may be mounted on the rear surface of the panel body 411. The first fixer 161 may be provided in a pair thereof at an upper end portion of the rear surface of the panel body 411. The first fixer 161 may be integrally formed with the edge cover 413.

The second fixer 166 may be mounted on the rear surface of the panel body 411. The second fixer 166 may be provided in a pair thereof at the lower end portion of the rear surface of the panel body 411.

The first fixer 161 and the second fixer 166 may allow the door panel 410 to be firmly coupled to and easily separated from the door body 120.

The fixing member 419 may be disposed along the circumference of the panel body 411. The fixing member 419 may be disposed at each edge of the panel body 411. The fixing member 419 may be fixed to the panel body 411 by a double-sided tape. The fixing member 419 may allow the door panel 410 to be more firmly fixed to the door body 120 when the door panel 410 is coupled to the door body 120.

The fixing member 419 may include a magnetic body. The fixing member 419 may be provided to generate an attraction force with respect to the cover 140 when the door panel 410 is coupled to the door body 120. The cover 140 may include steel. As the fixing member 419 is fixed to the cover 140 while in contact with thereto by the attraction force between the fixing member 419 and the cover 140, the door panel 410 may be more stably fixed to the door body 120.

The fixing members 419 disposed at the left and right end portions of the panel body 411 may extend in the vertical direction along the left and right side edges of the panel body 411. The fixing members 419 disposed at the left and right end portions of the panel body 411 may be disposed to be spaced apart from the left and right ends of the panel body 411 by a predetermined interval. Upper end portions of the fixing members 419 disposed at the left and right end portions of the panel body 411 may be disposed to come into close contact with the lower end of the edge cover 413.

The fixing member 419 disposed at the upper end portion of the panel body 411 may extend in the horizontal direction along the upper edge of the panel body 411, and may be discontinuously provided so as not to overlap the first fixer 161. The fixing member 419 disposed at the upper end portion of the panel body 411 may be disposed to come into close contact with the lower end of the edge cover 413. The fixing member 419 disposed at the upper end portion of the panel body 411 may be disposed to come into close contact with the lower end of the first fixer 161 that is integrally formed with the edge cover 413.

The fixing member 419 disposed at the lower end portion of the panel body 411 may extend in the horizontal direction along the lower edge of the panel body 411. The fixing member 419 disposed at the lower end portion of the panel body 411 may be disposed to be spaced apart from the lower end of the panel body 411 by a predetermined interval.

Figure 24:
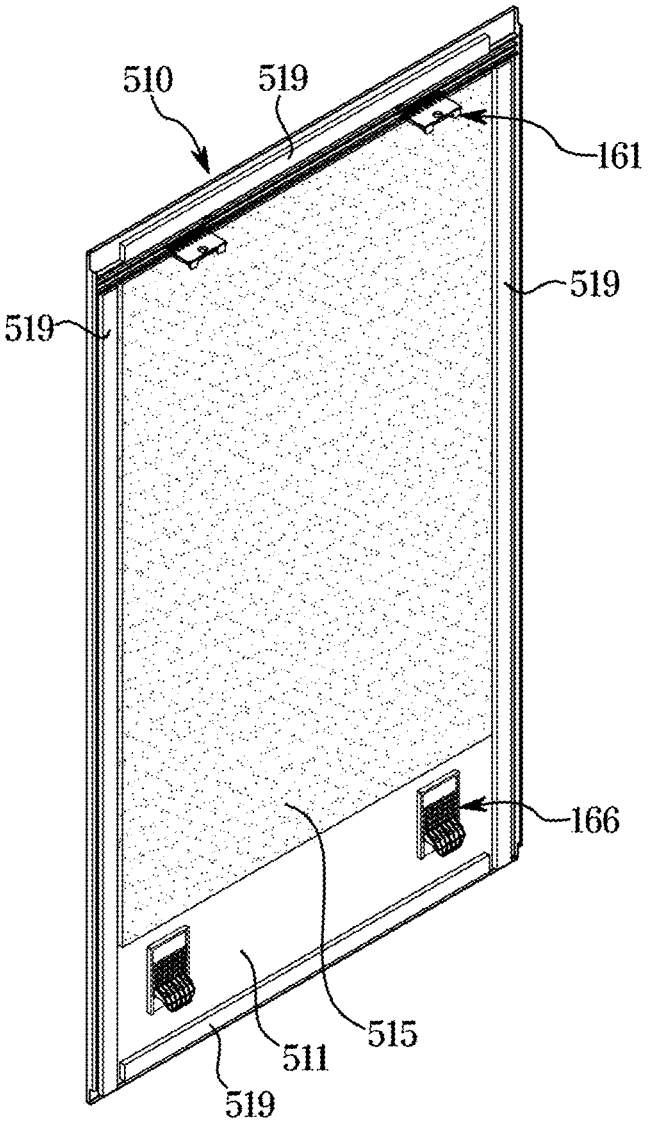
FIG. 24 is a view illustrating a rear surface of a door panel according to still another embodiment of the disclosure.

FIG. 24 is a view illustrating a rear surface of a door panel according to still another embodiment of the disclosure.

Referring to FIG. 24, a door panel 510 according to still another embodiment of the disclosure will be described. The door panel 510 illustrated in FIG. 24 may be applied to the first door 101 or the second door 102 illustrated in FIG. 1.

Referring to FIG. 24, the door panel 510 according to the embodiment of the disclosure may omit the edge cover 413, different from the door panel 410 illustrated in FIG. 23. The first fixer 161 may be provided in a pair thereof as an integral body, and the pair of first fixers 161 may be spaced apart from the upper end of the panel body 511 by a predetermined interval. The door panel 510 may be applied to the second door 102 shown in FIGS. 19 and 20.

In detail, the panel body 511 may form the external appearance of the door 100. The panel body 511 may have a flat plate shape. On the front surface of the panel body 511, a variety of designs may be formed to meet the needs of the user. The panel body 511 may include steel. First and second fixers 161 and 166 may be disposed on the rear surface of the panel body 511 to be coupled to the door body 120.

The buffer member 515 may be disposed on the rear surface of the panel body 511. The buffer member 515 may be disposed in a space formed between the door panel 510 and the cover 140. The buffer member 515 may be disposed between the first fixer 161 and the second fixer 166. The buffer member 515 may be configured to prevent the shock from being transmitted to the cover 140 when an impact is applied to the door panel 510. In addition, the buffer member 515 may be configured to absorb noise that may occur in the door panel 510. The buffer member 515 may include expanded polystyrene.

The first fixer 161 may be mounted on the rear surface of the panel body 511. The second fixer 166 may be mounted on the rear surface of the panel body 511. The first fixer 161 and the second fixer 166 may allow the door panel 510 to be firmly coupled to and easily separated from the door body 120.

A fixing member 519 may be disposed along the circumference of the panel body 511. The fixing member 519 may be disposed at each edge of the panel body 511. The fixing member 519 may be fixed to the panel body 511 by a double-sided tape. The fixing member 519 may allow the door panel 510 to be more firmly fixed to the door body 120 when the door panel 510 is coupled to the door body 120.

The fixing member 519 may include a magnetic body. The fixing member 519 may be provided to generate an attraction force with respect to the cover 140 when the door panel 510 is coupled to the door body 120. The cover 140 may include steel. As the fixing member 519 is fixed to the cover 140 while in contact with thereto by the attraction force between the fixing member 519 and the cover 140, the door panel 510 may be more stably fixed to the door body 120.

The fixing members 519 disposed at the left and right end portions of the panel body 511 may extend in the vertical direction along the left and right side edges of the panel body 511. The fixing members 519 disposed at the left and right end portions of the panel body 511 may be disposed to be spaced apart from the left and right ends of the panel body 511 by a predetermined interval. Upper end portions of the fixing members 519 disposed at the left and right end portions of the panel body 511 may be disposed to come into close contact with a lower end of an edge cover 513.

The fixing member 519 disposed at the upper end portion of the panel body 511 may extend in the horizontal direction along the upper edge of the panel body 511. The fixing member 519 disposed at the upper end portion of the panel body 511 may be disposed to come into close contact with the upper end of the first fixer 161. The fixing member 519 disposed at the upper end portion of the panel body 511 may be disposed between a gap between the upper end of the panel body 511 and the first fixer 161.

The fixing member 519 disposed at the lower end portion of the panel body 511 may extend in the horizontal direction along the lower edge of the panel body 511. The fixing member 519 disposed at the lower end portion of the panel body 511 may be disposed to be spaced apart from the lower end of the panel body 511 by a predetermined interval.

As is apparent from the above, the refrigerator includes a panel fixer provided on a door panel and a body fixer provided on a door body, so that the door panel can be easily replaced.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:
- a main body forming a storage compartment; and
- a door to open and close the storage compartment, and including:
  - a door body including:
    - a cover forming a front surface of the door body, and
    - chassis forming opposite sides of the door body, and including a left front end portion, and a right front end portion, and
  - a door panel detachably mountable on the door body, and including:
    - a panel body including a left bent portion and a right bent portion on opposite sides of the panel body, respectively,
    - an absorbing member on a rear surface of the panel body, and including a shock absorbing material and/or a sound absorbing material,
    - a left magnetic body on the rear surface at a left side of the absorbing member, and
    - a right magnetic body on the rear surface at a right side of the absorbing member,
  - wherein, when the door panel is mounted on the door body, the rear surface faces the cover, the left front end portion covers at least a portion of the left bent portion, the right front end portion covers at least a portion of the right bent portion, the left bent portion is between the left front end portion and the left magnetic body, and the right bent portion is between the right front end portion and the right magnetic body.

2. The refrigerator of claim 1, wherein, when the door panel is mounted on the door body, the cover is coupled with the left magnetic body and the right magnetic body by magnetic force.

3. The refrigerator of claim 1, wherein, when the door panel is mounted on the door body, the chassis supports the left bent portion and the right bent portion.

4. The refrigerator of claim 1, wherein the door panel includes:
- a lower fixer below the absorbing member, and
- an upper fixer above the absorbing member, and
- when the door panel is mounted on the door body, the lower fixer and the upper fixer are coupled to the door body.

5. The refrigerator of claim 4, wherein
- the door body includes an upper door cap having an opening at a front side of the upper door cap, and
- when the door panel is mounted on the door body, the upper fixer is inserted into the opening and fixed to the upper door cap.

6. The refrigerator of claim 5, wherein,
- the door body includes a lower door cap at an end portion of the door body opposite to the upper door cap, and protruding forward further than the cover, and,
- when the door panel is mounted on the door body, the lower door cap covers a portion of a lower surface of the door panel.

7. The refrigerator of claim 5, wherein
- the opening is exposed by the cover when the door panel is separated from the door body.

8. The refrigerator of claim 6, wherein, when the door panel is mounted on the door body, the door panel protrudes forward further than the lower door cap.

9. The refrigerator of claim 1, wherein the chassis includes a left edge accommodating groove and a right edge accommodating groove, and, when the door panel is mounted on the door body, the left bent portion and the right bent portion are accommodated in the left edge accommodating groove and the right edge accommodating groove, respectively.

10. The refrigerator of claim 1, further comprising:

a heat insulating material inside the door body, wherein, when the door panel is mounted on the door body, a front surface of the cover is spaced apart from the panel body, and a rear surface of the cover is in contact with the heat insulating material.

11. The refrigerator of claim 5, wherein the upper fixer includes a fixing hole formed to be fixed to the upper door cap by a fastening member.

12. The refrigerator of claim 11, wherein the upper door cap includes a through-hole formed at an upper side of the opening of the upper door cap to allow the fastening member to be inserted through the through-hole and pass through the fixing hole.

13. The refrigerator of claim 4, wherein the upper fixer includes a first upper fixer and a second upper fixer spaced apart from each other along an upper edge of the panel body.

* * * * *